United States Patent [19]

Fajt et al.

[11] 4,351,578

[45] Sep. 28, 1982

[54] AUTOMATED LAMP AGING

[75] Inventors: John Fajt; James V. Neal, Jr., both of Wynnewood, Okla.

[73] Assignee: Xenell Corporation, Wynnewood, Okla.

[21] Appl. No.: 186,615

[22] Filed: Sep. 12, 1980

[51] Int. Cl.[3] ..... H01J 9/00

[52] U.S. Cl. ..... 316/1; 140/147; 198/389; 198/451; 198/656; 316/27

[58] Field of Search ..... 316/1, 27; 140/147; 198/389, 624, 448, 452, 451, 645, 656

[56] References Cited

U.S. PATENT DOCUMENTS

| | | | |
|---|---|---|---|
| 477,093 | 6/1892 | Wead | 198/389 |
| 1,092,602 | 4/1914 | Smith et al. | 198/32 |
| 1,208,846 | 12/1916 | Sheldon et al. | 294/100 |
| 1,453,493 | 5/1923 | Cunningham | 294/86.14 |
| 1,646,258 | 10/1927 | Raus et al. | 140/71.5 |
| 1,791,044 | 2/1931 | Steele | 198/461 |
| 1,842,158 | 1/1932 | Ferguson et al. | 316/27 |
| 1,861,271 | 5/1932 | Herre | 140/71.5 |
| 1,955,794 | 4/1934 | Du Mont et al. | 316/27 |
| 2,121,665 | 6/1938 | Hudson | 219/4 |
| 2,137,181 | 11/1938 | Quackenbush | 219/57 |
| 2,203,151 | 6/1940 | Iversen | 219/4 |
| 2,379,135 | 6/1945 | Ekstedt et al. | 140/71.5 |
| 2,449,505 | 9/1948 | Pityo et al. | 219/4 |
| 2,454,338 | 11/1948 | Pityo et al. | 219/4 |
| 2,459,625 | 1/1949 | Copp | 219/4 |
| 2,477,894 | 8/1949 | Pityo et al. | 219/4 |
| 2,493,560 | 1/1950 | Vasselli | 140/147 |
| 2,578,835 | 12/1951 | Pityo et al. | 219/4 |
| 2,605,537 | 8/1952 | Pityo et al. | 29/33 |
| 2,606,268 | 8/1952 | Pityo et al. | 219/10 |
| 2,644,069 | 6/1953 | Pityo | 219/4 |
| 2,734,119 | 2/1956 | Pityo | 219/10 |
| 2,749,420 | 6/1956 | Pityo | 219/4 |
| 2,776,037 | 1/1957 | Baigent | 198/30 |
| 2,784,297 | 3/1957 | Pityo | 219/78 |
| 2,798,514 | 7/1957 | Mullan | 140/71.5 |
| 2,812,994 | 11/1957 | Kimball et al. | 316/27 |
| 2,846,561 | 8/1958 | Pityo | 219/79 |
| 2,848,793 | 8/1958 | Pityo | 29/155.5 |
| 2,915,616 | 12/1959 | Griffin | 219/159 |
| 2,916,056 | 12/1959 | O'Brien et al. | 140/71.5 |
| 2,936,797 | 5/1960 | Mullan et al. | 140/71.5 |
| 3,003,051 | 10/1961 | Kulicke, Jr. et al. | 219/56.1 |
| 3,003,052 | 10/1961 | Williams et al. | 219/101 |
| 3,005,900 | 10/1961 | Pityo | 219/79 |
| 3,045,739 | 7/1962 | Fyfe et al. | 153/2 |
| 3,059,321 | 10/1962 | Pityo | 29/155.5 |
| 3,064,792 | 11/1962 | Du Broff | 198/32 |
| 3,071,166 | 1/1963 | Gutbier | 140/1 |
| 3,075,562 | 1/1963 | Jankowski | 140/147 |
| 3,079,958 | 3/1963 | Helda | 140/147 |
| 3,101,866 | 8/1963 | Anderson | 221/93 |
| 3,106,945 | 10/1963 | Wright et al. | 140/147 |
| 3,126,087 | 3/1964 | Anderson | 198/34 |
| 3,138,239 | 6/1964 | Ackerman et al. | 198/656 |
| 3,144,119 | 8/1964 | Nigrelli et al. | 198/32 |
| 3,144,889 | 8/1964 | Cole | 140/140 |
| 3,195,584 | 7/1965 | Zimmerman et al. | 140/147 |
| 3,220,443 | 11/1965 | Smith et al. | 140/147 |
| 3,225,797 | 12/1965 | Stoody | 140/147 |
| 3,251,640 | 5/1966 | Wennin | 316/1 |
| 3,258,830 | 7/1966 | Pityo | 29/155.55 |
| 3,291,168 | 12/1966 | Zitner | 143/57 |
| 3,294,948 | 12/1966 | Fegley et al. | 219/56.1 |
| 3,297,130 | 1/1967 | Greck | 198/33 |
| 3,300,617 | 1/1967 | Buck et al. | 219/117 |
| 3,319,668 | 5/1967 | Shambelan | 140/147 |
| 3,321,606 | 5/1967 | Cropp et al. | 219/79 |
| 3,321,825 | 5/1967 | Cooke | 29/203 |
| 3,332,530 | 7/1967 | Greulich | 198/32 |
| 3,337,257 | 8/1967 | Brynsvold | 294/90 |
| 3,344,816 | 10/1967 | Zemek | 140/147 |
| 3,352,331 | 11/1967 | Swyt | 140/147 |
| 3,365,048 | 1/1968 | Ehrlich et al. | 198/33 |
| 3,396,758 | 8/1968 | Hall | 140/1 |
| 3,479,712 | 11/1969 | Pityo | 29/38 |
| 3,517,157 | 6/1970 | Best et al. | 219/85 |
| 3,520,336 | 7/1970 | Zemek | 140/147 |
| 3,536,179 | 10/1970 | Pearson | 198/32 |
| 3,537,276 | 11/1970 | Pityo | 65/59 |
| 3,542,087 | 11/1970 | Fegley | 140/147 |
| 3,567,006 | 3/1971 | Bell et al. | 198/33 |
| 3,675,755 | 7/1972 | Hopwood-Jones | 198/33 |
| 3,687,263 | 8/1972 | Randrup | 198/33 AA |
| 3,778,584 | 12/1973 | Fajt et al. | 219/101 |
| 3,815,730 | 6/1974 | Zwiep et al. | 198/287 |
| 3,841,461 | 10/1974 | Henderson et al. | 198/32 |
| 3,850,281 | 11/1974 | Focke et al. | 198/32 |
| 3,850,286 | 11/1974 | Tobin, Jr. | 198/210 |
| 3,935,773 | 2/1976 | Daebler | 83/331 |
| 3,941,165 | 3/1976 | Bowden et al. | 140/147 |

| | | | |
|---|---|---|---|
| 4,002,191 | 1/1977 | Lorenzini | 140/147 |
| 4,024,614 | 5/1977 | Utterback et al. | 228/4.5 |
| 4,049,414 | 9/1977 | Smith | 65/11 |
| 4,094,410 | 6/1978 | Fegley et al. | 209/73 |

FOREIGN PATENT DOCUMENTS

| | | | |
|---|---|---|---|
| 853084 | 11/1960 | United Kingdom | 198/498 |

OTHER PUBLICATIONS

Publication of Kahle Engineering Company of Union City, New Jersey, Machine Number 4719, Automatic Stem Machine.

Publication of Kahle Engineering Company of Union City, New Jersey, Machine Number 2545, Automatic Pinch Seal Stem Machine.

Publication of Kahle Engineering Company of Union City, New Jersey, Machine Number 4318, Neon Glow Lamp Production Machine.

Publication of Kahle Engineering Company of Union City, New Jersey, Machine Number 15-B, Twenty-Four Head Exhaust Machine with Short Compressible Rubbers.

Publication of Kahle Engineering Company of Union City, New Jersey, Brochure No. 6903, entitled "KAHLE Specialists in Automation for all Industries".

Publication of Kahle Engineering Company of Union City, New Jersey, Bulletin REP 70.

Publication of Kahle Engineering Company of Union City, New Jersey, Reprint from AUTOMATION, Sep. 1971, entitled "Combining Processing and Assembly Operations", by Carl A. Napor.

Publication of Kahle Engineering Company of Union City, New Jersey, Reprint from INSTRUMENTATION, vol. 7, No. 6, entitled "Slick Little Switch".

*Primary Examiner*—John McQuade

*Attorney, Agent, or Firm*—Laney, Dougherty, Hessin & Beavers

[57] ABSTRACT

Automated apparatus and methods are provided for aging negative glow lamps.

52 Claims, 23 Drawing Figures

AUTOMATED LAMP AGING

BACKGROUND OF THE INVENTION

1. Field of the Invention

The present invention relates generally to apparatus for handling electrical components, and more particularly, but not by way of limitation, to such apparatus designed for use with negative glow lamps.

2. Description of the Prior Art

A negative glow lamp is an electrical component having a cylindrical glass bulb approximately ½ inch in length and ¼ inch in diameter. Extending downwardly from the bulb is a lower bulb portion which is a substantially flat tab formed during the bulb manufacturing process. This lower bulb portion extends downwardly approximately ¼ inch and has a width of approximately ¼ inch, and a thickness of approximately 1/16 inch. Disposed within the bulb are first and second filaments. Attached to the first and second filaments and extending downwardly from the lower bulb portion are first and second copper lead wires having a length of approximately 1½ inches. These lead wires are substantially parallel and lie substantially in the plane of the flat tab extending down from the bulb.

Such negative glow lamps are manufactured in batches, and a typical lamp manufacturing process produces lamps in batches of eight.

During the process of manufacturing, the electrodes of each lamp are dipped in a liquid before the bulb is sealed. After the bulbs have been sealed it is necessary to pass an electric current through the led wires of each lamp, which causes a chemical reaction to occur in the coating on the electrodes, as is well known to those skilled in the art. This process of passing a current through the electrodes to cause the chemical reaction is referred to as "aging" the lamps.

With prior art apparatus and methods the batches of lamps are typically dropped randomly into a container after the bulbs are sealed. Then each lamp is manually removed from the container and its lead wires are engaged with electrical contacts so that the aging process can be performed.

SUMMARY OF THE INVENTION

The present invention provides automated apparatus and methods for taking the batches of lamps from the lamp manufacturing process and aging the lamps.

the lamps are released in batches of eight from a lamp manufacturing turntable. A sequencing lamp feeder then feeds each batch of lamps, one lamp at a time, onto a conveyor. The feeding conveyor conveys the lamps in a single line to a lamp positioning roller assembly which orients the lamps vertically and then feeds them to a first predetermined position. A first transfer arm then picks up each lamp from the first position and transfers it to a lamp aging conveyor when the lead wires are in contact with a pair of lead wire receptacles. As the lamps are conveyed down the aging conveyor, an electric current is repeatedly directed to each pair of lead wire receptacles to age the lamps.

It is, therefore, a general object of the present invention to provide improved methods and apparatus for handling electrical components.

Another object of the present invention is the provision of improved apparatus and methods for handling negative glow lamps.

Yet another object of the present invention is to provide apparatus and methods for automated aging of negative glow lamps.

BRIEF DESCRIPTION OF THE DRAWINGS

FIG. 18 is a front elevation view of the separator insert.

DETAILED DESCRIPTION OF THE PREFERRED EMBODIMENTS

Figure 1:
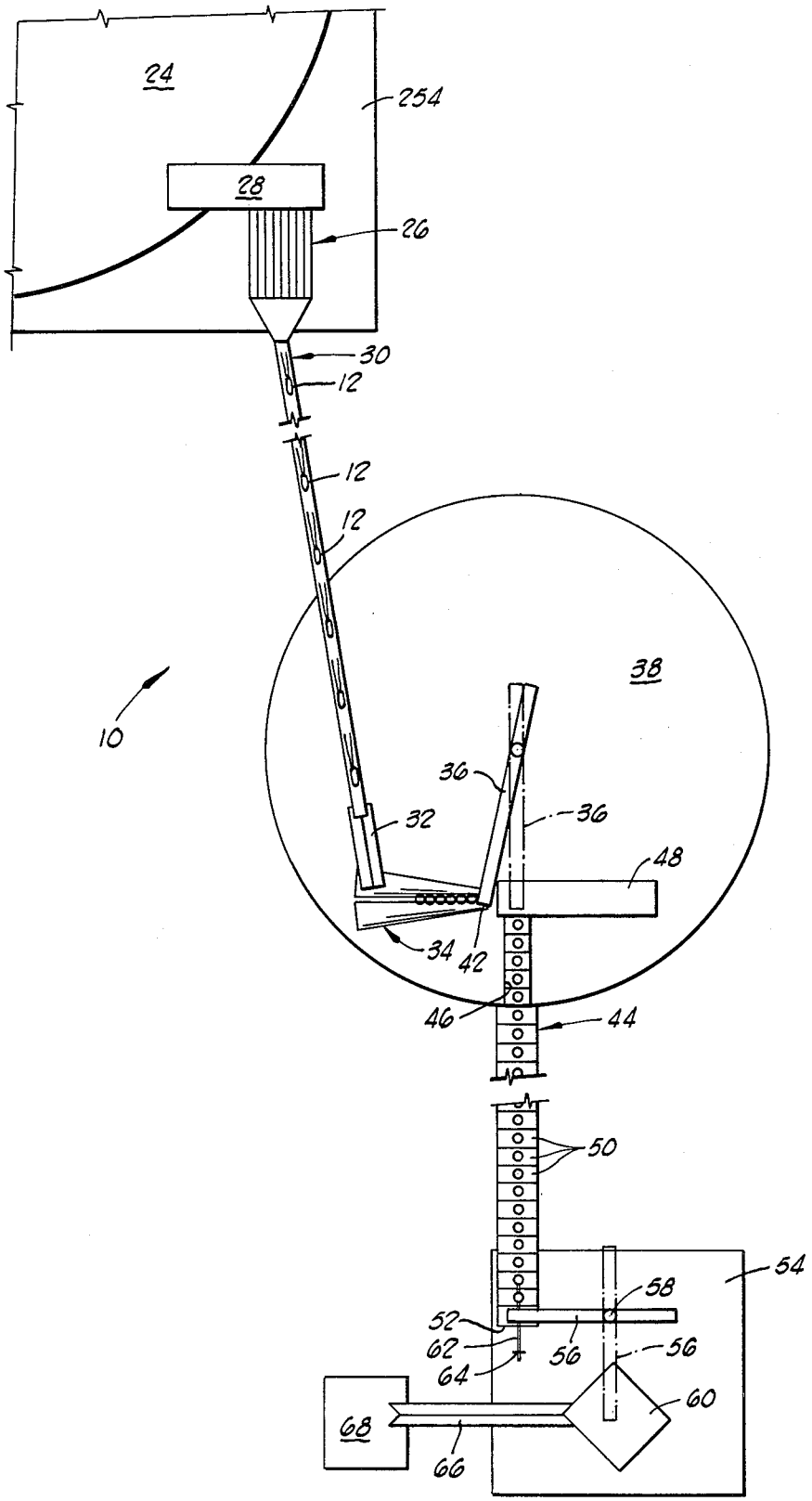
FIG. 1 is a schematic plan view of an automated lamp aging system.

Referring now to the drawings, and particularly to FIG. 1, the automated aging system of the present invention is schematically shown and generally designated by the numeral 10. This is a system for the automated aging of negative glow lamps.

Figure 2:
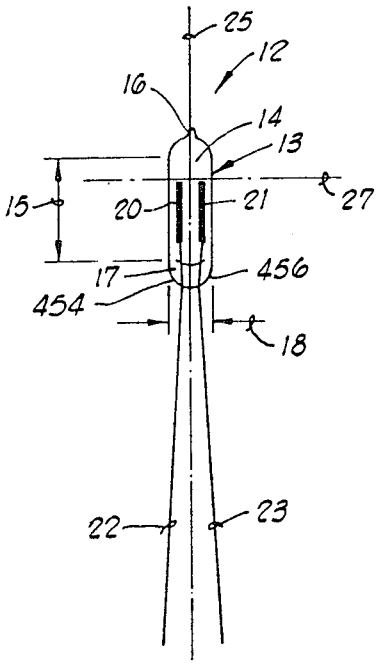
FIGS. 2 and 3 are elevation views of a negative glow lamp.
Figure 3:
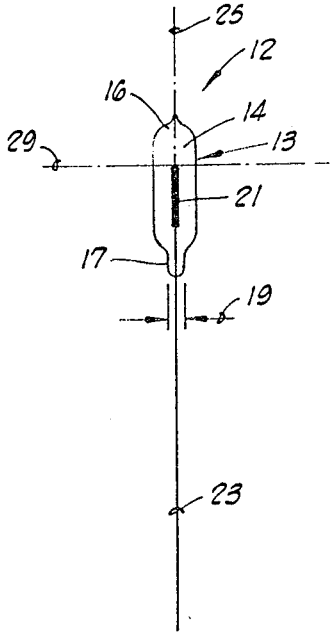

Referring to FIGS. 2 and 3, a negative glow lamp 12, which may generally be referred to as an electrical component, is thereshown. The negative glow lamp 12, which itself is well known in the prior art, will now be described for purposes of reference. The negative glow lamp 12 includes a bulb 13. The bulb 13 has a cylindrical portion 14 having a length 15 of approximately ½". The cylindrical portion 14 has an outside diameter, which is its greatest minimum cross-sectional dimension, of approximately ¼". It will be understood that for any section cut through the bulb 13 perpendicular to its longitudinal axis there will be a minimum cross-sectional dimension. The greatest of these minimum cross-sectional dimensions determines the smallest width of a slot through which the bulb 13 could pass.

At the upper end of cylindrical part 14 is a roughly conical closed tip 16 which is formed during the bulb manufacturing process.

Extending downward from the lower end of cylindrical part 14 is a flat bottom bulb portion 17 which closes the bottom of hollow cylindrical part 14. Flat bottom bulb portion 17 has a width 18 of approximately $\frac{1}{4}''$ and has a thickness 19, as can best be seen in FIG. 3, of approximately 1/16".

Received within bulb 13 are first and second filaments 20 and 21. The filaments 20 and 21 are substantially parallel and spaced apart as can be seen in FIG. 2. Attached to filaments 20 and 21 are first and second lead wires 22 and 23 which extend therefrom downward through the flat bulb portion 17. Lead wires 22 and 23 extend downward a length of approximately $1\frac{1}{2}''$ below bulb 13. The lead wires 22 and 23 are encased in lower part 17 of bulb 13 where they pass therethrough and are substantially parallel to each other and lie within the plane of filaments 20 and 21 and the plane of lower bulb portion 17. It will be understood by those skilled in the art, that the lead wires 22 and 23 will, of course, often be slightly bent away from each other or out of the plane of FIG. 2. The construction of the lamp 12 is, however, such that if the lead wires 22 and 23 are not deformed, but rather extend axially from the filaments 20 and 21, they will be substantially parallel to each other and lie in the plane of flat bottom bulb portion 17 and in the plane of filaments 20 and 21.

This is further illustrated in FIG. 3, in which lamp 12 is rotated 90° about a vertical axis from the view shown in FIG. 2, so that only the second filament 21 and the second lead wire 23 are shown.

The geometric configuration of the lamp 12 may best be described by defining first, second and third mutual perpendicular body axes of the lamp 12. Those axes, which will be understood as being imaginary axes, are defined as follows.

A longitudinal axis through cylindrical part 14 of lamp bulb 13 is defined as a first body axis 25. Perpendicular to axis 25 and lying within a plane defined by filaments 20 and 21 and lower flat bulb portion 17 is a second body axis 27. The axes 25 and 27 define the plane of the paper on which FIG. 2 is drawn.

A third body axis 29 is perpendicular to both said first and second axes 25 and 27 and may be seen in FIG. 3 where the axes 25 and 29 define the plane of the paper on which FIG. 3 is drawn.

As can be seen in FIG. 2, the first and second lead wires 22 and 23 extend from lower bulb portion 17 substantially parallel to first body axis 25 and spaced apart in a direction parallel to second axis 27.

The system 10 provides an automated system for handling the lamp 12 during the aging process and for subsequently trimming the length of the lead wires 22 and 23.

The lamps 12 are manufactured on a conventional rotary lamp building tble 24. The lamps are manufactured in batches of eight lamps.

Placed adjacent the rotary lamp building table 24 is a sequencing lamp feeder 26. A batch of eight lamps from the lamp manufacturing table 24 are transferred to the lamp feeder 26 by a batch release means 28.

The sequencing lamp feeder 26 transfers the eight lamps sequentially to an endless conveyor belt 30. The purpose of the lamp feeder 26 is to prevent the eight lamps from a given batch from bunching up on the conveyor 30. Lamp feeder 26 causes the lamps to drop one at a time onto the conveyor 30 so that they are traveling down the conveyor head first in a single line as shown by the lamps illustrated upon the conveyor belt 30.

At the end of conveyor belt 30 the lamps 12 are dropped down a sloped chute 32 which feeds the lamps 12 to a lamp alignment roller assembly 34.

The lamp alignment roller assembly 34 aligns the lamps 12 in a vertical manner and rotationally positions them about a vertical axis so that the lead wires 22 and 23 extend downward in a plane approximately the same as that of a vertical plane extending between the two rollers of lamp alignment roller assembly 34.

The lamp alignment roller assembly 34 causes the lamps 12 to move to the right as seen in FIG. 1 so that they are aligned in a row adjacent the rightmost end of tapered rollers 34.

A transfer arm 36 extends upward from a table frame 38 so as to pivot about a vertical axis of a vertical support rod.

Transfer arm 36 includes a means at its outer end 42 for picking up one of the lamps 12 from the lamp alignment roller assembly 34. The transfer arm 36 then pivots counterclockwise as seen in FIG. 1 to the position shown in phantom lines. At this point, the outer end 42 of transfer arm 36 is located above a lamp aging conveyor 44. An opening 46 is cut in table frame 38 and the aging conveyor 44 runs therebelow as can be seen in FIG. 1.

A lamp lead wire separator and alignment apparatus 48 then separates the lead wires 22 and 23 of the lamp 12 and straightens the same so that they are oriented approximately as shown in FIG. 2. Then the outer end 42 of transfer arm 36 moves downward inserting the lead wires 22 and 23 into powered receptacles in a carrier block 50 of aging conveyor 44. The lamp 12 is then released by transfer arm 36 and the transfer arm 36 moves back to the position shown in solid lines in FIG. 1.

The aging conveyor 44 is an endless conveyor made up of a plurality of the carrier blocks 50 connected to the links of a pair of parallel roller chains. As the lamp 12 is moved down the conveyor 44, an electric current is periodically passed therethrough for the purpose of aging the lamp to cause the requisite chemical reaction within the bulb 14. Any defective lamps may be visually detected as the lamps are carried down the conveyor 44 and may be removed therefrom by hand.

A second end 52 of conveyor 44 is located adjacent a second table frame 54. A second transfer arm 56, similar to first transfer arm 36, is mounted so as to pivot about a vertical axis of vertical rod 58.

The second transfer arm 56 is initially in a position shown in solid lines in FIG. 1 so that it may pick up a lamp 12 from the conveyor 44. Then the transfer arm 56 rotates counterclockwise to the position shown in phantom lines, which carries the lamp 12 into engagement with a cutter assembly 60 for trimming the lead wires of the lamp.

When the lamps are initially picked up from the second end of conveyor belt 44, their position within a holding device attached to the outer end of transfer arm 56 is determined by a lifting arm 62 pivoted about its rear end 64, which pushes the lamps 12 up into the holding device of transfer arm 56 to a predetermined elevation so as to determine the elevation at which the lead wires of the lamp 12 engage the cutters of cutter assembly 60.

After the lead wires are trimmed at cutter assembly 60, the lamps are dropped down an inclined chute 66 which directs them into a container 68.

The Sequencing Lamp Feeder

Figure 4:
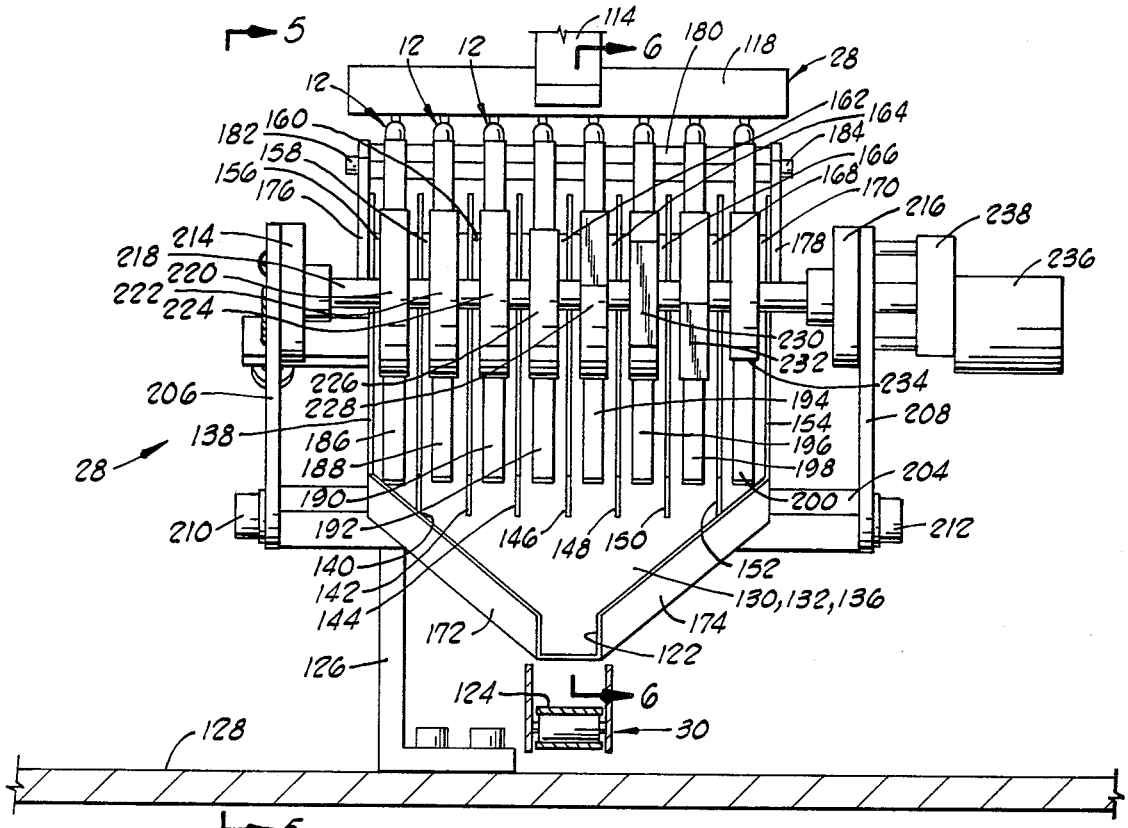
FIG. 4 is a front elevation view of a sequencing lamp feeder.
Figure 5:
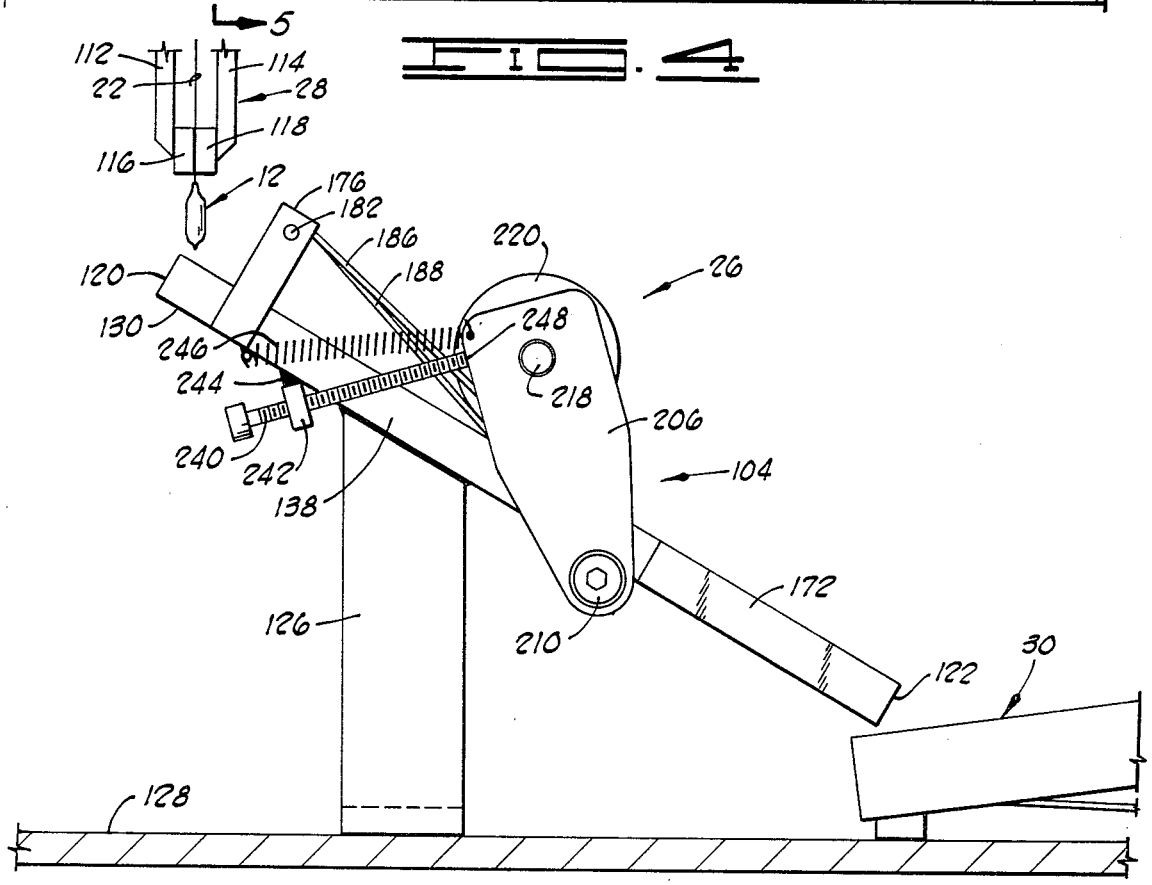
FIG. 5 is a view along line 5—5 of FIG. 4, showing a side elevation view of the sequencing lamp feeder.

Referring now to FIGS. 4 and 5, the sequencing lamp feeder 26 is shown in detail. Also shown are the batch release means 28 and the front end of conveyor 30.

The batch release means 28 is a part of a typical prior art lamp manufacturing apparatus which, as a final step, grasps a batch of eight lamps 12 by their lead wires 22 and 23 and carries them to a point at which they are to be released. The batch release means 28 includes a pair of vertical arms 112 and 114 (best seen in FIG. 5) which have parallel horizontal clamping plates 116 and 118 attached to their lower ends. The arms 112 and 114 can move apart to release the lamps 12 or to allow the lamps 12 to be received therebetween. The arms 112 and 114 may then be moved together to clamp the lead wires 22 and 23 of lamps 12 between clamping plates 116 and 118.

As mentioned, in a typical prior art lamp manufacturing apparatus the batch release means 28 clamps the leads 22 and 23 of a batch of eight lamps 12 and removes them from the lamp manufacturing apparatus. The batch of lamps 12 is then carried to a position typically over a box or other container and the arms 112 and 114 are spread apart thereby releasing the lamps 12.

In the present invention, the batch release means 28 stops at a position located above an upper end 120 of lamp feeder means 26. The lamps 12 are then released and dropped into the lamp feeder 26 as is further described below.

A feeder outlet 122 is located at a lower end of lamp feeder means 26, and the conveyor means 30 is located below outlet 122 for receiving the lamps 12 therefrom.

The conveyor 30 includes an endless leather belt 124 which travels in a direction away from the lamp feeder means 26 to carry the lamps 12 to chute 32 and rollers 34.

The lamp feeder means 26 provides a means for receiving batches of eight lamps 12 from the batch release means 28 and for feeding the eight lamps of each batch one at a time to the feeder outlet 122 so that they may be received one at a time upon the moving belt 124 of conveyor 30 which conveys the lamps 12 in a single line up the conveyor 30, as seen in FIG. 1.

Lamp feeder means 26 will now be described with reference to FIGS. 4–6. Feeder means 26 includes a support frame 126 which is attached to a table frame 128.

A bottom plate 130 which has an inclined planar top surface 132 is attached to the upper end of support frame 126 as is best shown in FIG. 5.

The inclined surface 132 includes an upper rectangular portion 134 and a lower trapezoidal portion 136.

Nine walls 138 through 154 extend upward from upper portion 134 of inclined surface 132 and divide said upper portion 134 of inclined surface 132 into eight parallel chutes 156–170.

As is best seen in FIG. 4, the batch release means 28 releases the eight lamps 12 simultaneously dropping one into each of the chutes 156–170.

Connected to the first and ninth walls 138 and 154 are a pair of lower converging side walls 172 and 174 which converge downwardly to the feeder outlet 122.

As is best seen in FIG. 4, there are near the upper end 120 of component feeder means 26 first and second posts 176 and 178 which extend upwardly from the first and ninth walls 138 and 154.

A strip mounting bar 180 is connected between posts 176 and 178 by screws 182 and 184.

Figure 6:
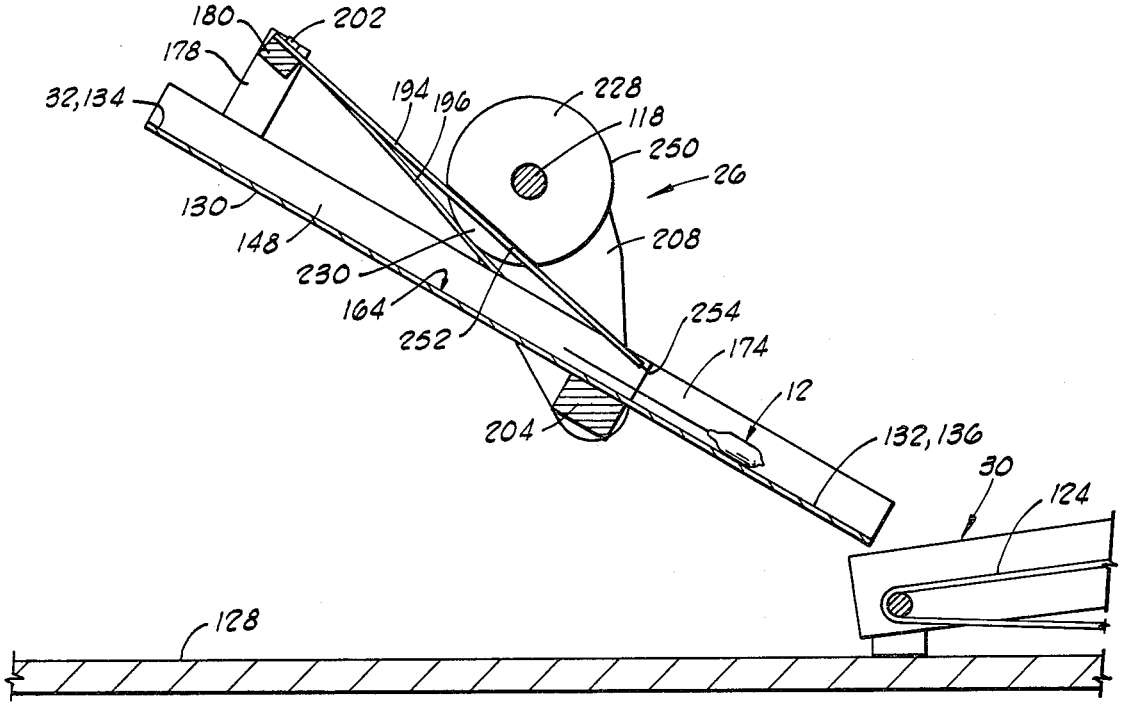
FIGS. 6 and 6A are views along line 6—6 of FIG. 4, showing a chute in its open and closed positions, respectively.

Eight spring strips 186–200 have their upper ends attached to spring mounting bar 180 by screws such as 202 best seen in FIG. 6.

Attached to the bottom side of bottom plate 130 is a horizontal support bar 204 which has support plates 206 and 208 attached to its ends by machine screws 210 and 212.

Rotatably mounted between support plates 206 and 208 in bearing blocks 214 and 216 is a camshaft 218.

Attached to camshaft 218 are eight eccentric cams 220–234.

Camshaft 218 is driven by an electric motor 236 through a gear reducer 238 mounted upon support plate 208.

As best seen in FIG. 5, an adjustment bolt 240 is threaded into a tapped and threaded hole within a plate 242 attached to bottom plate 130 at weld 244. A retaining spring 246 biases support plate 206 against an outer end 248 of adjustment bolt 240 so that a height of camshaft 218 above bottom plate 130 may be adjusted by rotation of adjustment bolt 240, thus adjusting a downward deflection of spring strips 186–200.

Figure 6A:
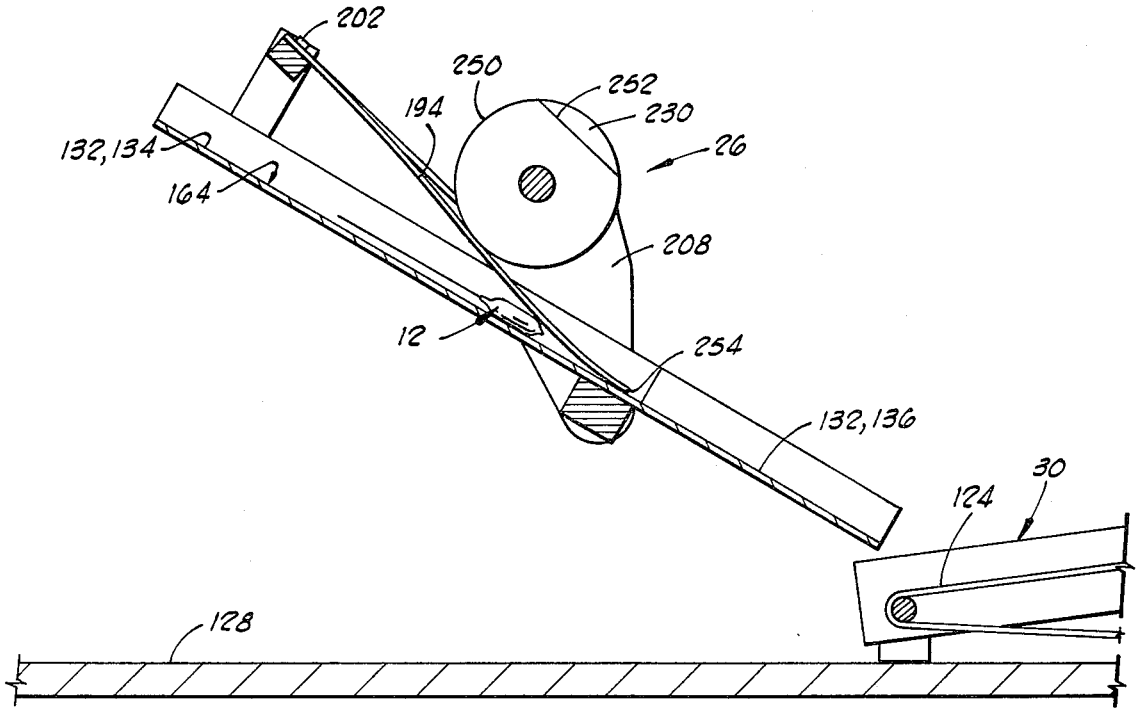

The relationship of the eight chutes 156–170, the eight spring strips 186–200, and the eight eccentric cams 220–234, is best shown in FIGS. 6 and 6A which illustrate the opened and closed positions, respectively, of fifth chute 164. The fifth eccentric cam 228 is shown in profile in FIGS. 6 and 6A. Fifth eccentric cam 228 includes a peripheral outer surface including a partially circular portion 250 and a flat portion 252 which defines a chord of the partially circular portion 250. The partially circular portion 250 has a center of curvature coincident with the axis of rotation of camshaft 218.

In FIG. 6 the fifth cam 228 is shown in its open position with its flat chord portion 252 in engagement with an intermediate part of fifth spring strip 194 thereby allowing the spring strip 194 to move upward out of engagement with the inclined surface 134 due to the resilience of the spring strip 194. Thus, a lamp 12 may pass under the spring strip 194 between its lower end 254 and the inclined surface 132.

When eccentric cam 228 is rotated to such position that its partially circular surface 250 is in engagement with the spring strip 194 the spring strip 194 is oriented as shown in FIG. 6A with its lower end 254 engaging the inclined surface 132 so as to close the chute 164 and prevent a lamp 12 from sliding down the chute 164.

The eight eccentric cams 220–234 are preferably offset 45° from each other and are arranged so that only one of the eight chutes 156–170 is opened at any given time. Thus, with a single rotation of camshaft 218, each of the chutes 156–170 is opened for approximately $\frac{1}{8}$ of the period of time required for the one revolution of camshaft 218.

The camshaft 218 therefore provides a means for periodically blocking and periodically opening each of the chutes 156–170. This is down by engagement of the eight cams 220–234 with intermediate portions of the eight spring strips 186–200 so as to cause the strips 186–200 to cyclically move between a down position such as shown in FIG. 6A for fifth strip 194 and blocking its respective chute such as chute 164, and an up position as shown in FIG. 6 allowing a lamp 12 to slide down the fifth chute 164. Each of the lamps 12 that is allowed to drop through one of the chutes 156–170 is directed by converging side walls 172 and 174 to the feeder outlet 122 from which it drops to the conveyor means 30.

A typical lamp manufacturing machine 24 produces a batch of eight lamps approximately every six or seven seconds. In a preferred embodiment, the drive means of the present invention, including motor 236 and gear reducer 238, are so constructed that the camshaft 218 rotates at a speed of approximately 10 rpm so that it goes through approximately 1½ revolutions for every batch of lamps released by the batch release means 28. In this manner, approximately twelve openings of a chute are provided for every eight lamps dropped in the eight chutes. This insures that each chute is opened at least once for each batch of lamps dropped into the feeder means 26 and allows for some variation in the period between the release of batches of lamps thereby preventing the lamps from collecting in the feeder means 26.

Figure 8:
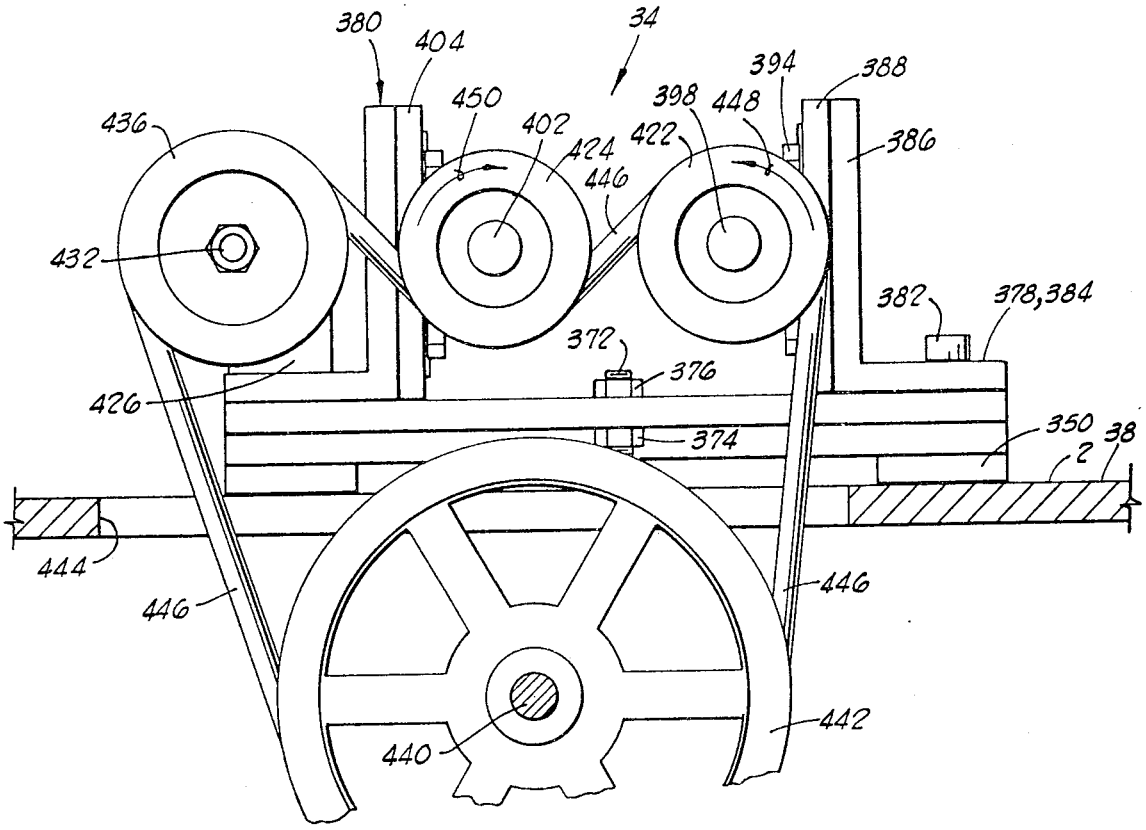
FIG. 8 is a side elevation view of the apparatus of FIG. 7.
Figure 7:
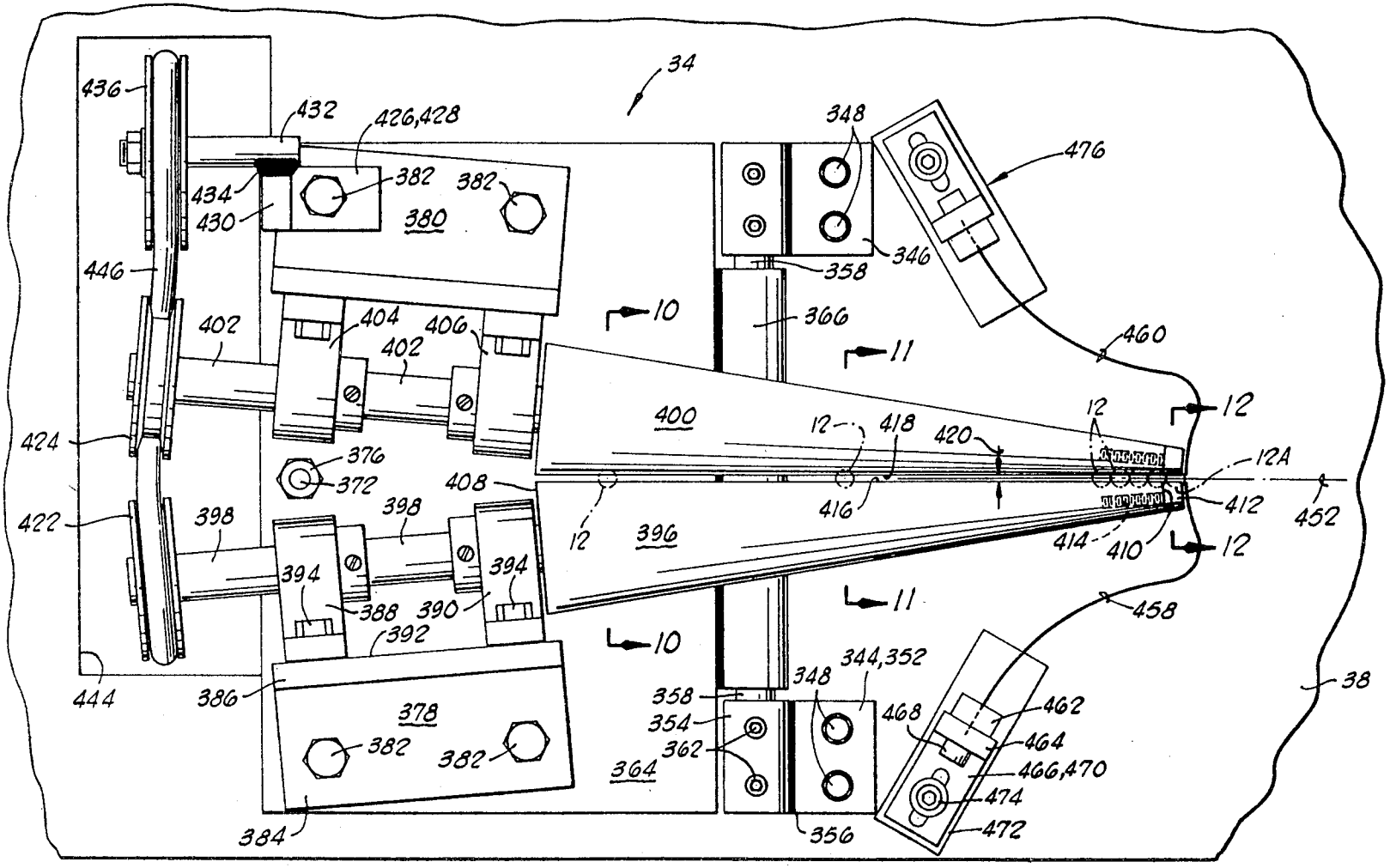
FIG. 7 is a plan view of a lamp positioning roller assembly.
Figure 9:
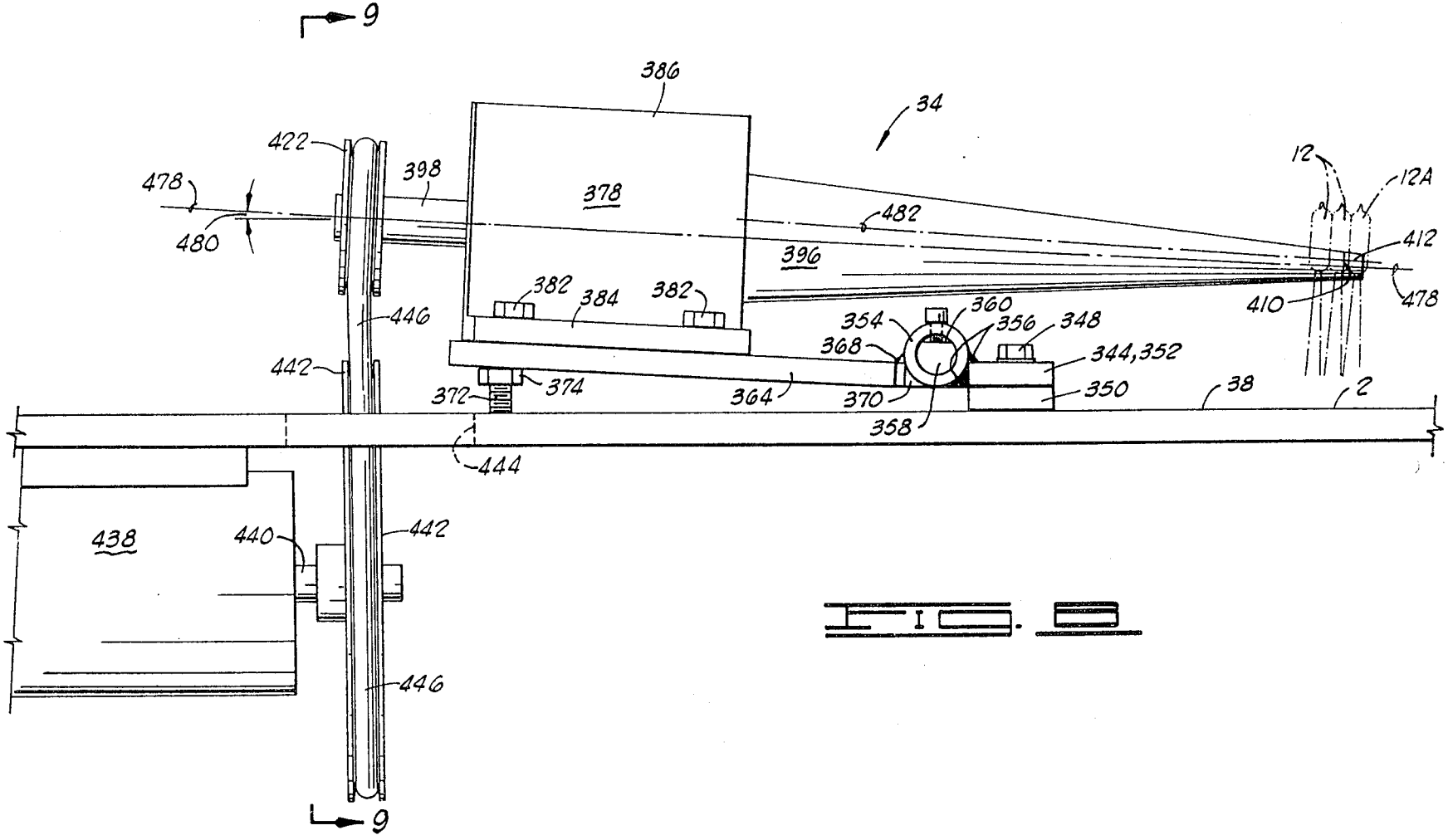
FIG. 9 is a rear elevation view of the apparatus of FIGS. 7 and 8 taken along line 9—9 of FIG. 8.

The Positioning Rollers of FIGS. 7–9

Referring to FIGS. 7 and 8, the lamp positioning roller assembly is thereshown and generally designated by the numeral 34. Roller assembly 34 is mounted upon the table frame 38 of adjacent transfer arm 36.

First and second roller attachment hinges 344 and 346 are attached to table frame 38 by allen screws 348. The table frame 38 is threaded and tapped to receive the allen screws 348.

Shims 350 are placed below roller attachment hinges 344 and 346 to adjust a vertical position thereof.

First roller attachment hinge 344 includes a plate portion 352 having a hollow cylindrical portion 354 welded to the back edge thereof at weld 356. Second roller attachment hinge 346 is similarly constructed.

A hinge bar 358 is received within the inner bores of first and second roller attachment hinges 344 and 346. Each end of hinge bar 358 includes a flat surface 360.

Hollow cylindrical part 354 of first roller attachment hinge 344 has two threaded holes in the upper side thereof within which are received allen screws 362 which are utilized as set screws to set against flat surface 360 of hinge bar 358 to fix hinge bar 358 relative to hollow cylindrical part 354.

A roller carrier plate 364 has a hollow cylindrical middle hinge portion 366 attached to a front edge thereof by welding as shown at 368 and 370.

Hinge bar 358 is received through central bore of middle hinge portion 366 which is rotatable relative thereto so that roller carrier plate 364 may be rotatably adjusted about the horizontal longitudinal axis of pivot bar 358 relative to table frame 38.

An adjustment bolt 372 extends upward from table frame 38 and has lower and upper adjustment nuts 374 and 376 threadedly engaged therewith and engaging lower and upper surfaces, respectively, of roller carrier plate 364. Thus, the rotational position of carrier plate 364 about pivot bar 358 may be adjusted by rotating the nuts 374 and 376 upon the threads of adjustment bolt 372.

First and second L-shaped roller support brackets 378 and 380 are attached to roller carrier plate 364 by allen screws 382.

First support bracket 378 includes a shorter horizontal leg 384 and a longer vertical leg 386. Second support bracket 380 is similarly constructed. First and second bearing blocks 388 and 390 are attached to an inner surface 392 of vertical leg 386 of first support bracket 378 by allen screws 394.

A first substantially horizontally extending conically tapered roller 396 includes a shaft 398 extending rearwardly therefrom which is rotatably received within bearing blocks 388 and 390.

Similarly, a second roller 400 has a shaft 402 which is received within bearing blocks 404 and 406 which are attached to second support bracket 380.

In a preferred embodiment of the tapered rollers 398 and 400, the roller 398 has a rear end 408 with a diameter of 2" and has a front end 410 with a diameter of 0.380". Roller 398 has an axial length of 9⅞" between front and rear ends 410 and 408. A hardened tool steel tip insert 412 has a threaded bolt extending rearwardly thereof which is received within threaded and tapped hole 414 in front end 410 of roller 396. Tip insert 412 is tapered continuously along the profile projecting from the outer surface of roller 396.

Second roller 400 is constructed similarly to first roller 396.

As shown in FIG. 7, the innermost or closest edges 416 and 418 of rollers 396 and 400 are oriented parallel to each other and spaced apart by a distance 420 which in a preferred embodiment is ⅛".

Attached to the rear end of shafts 398 and 402 of first and second rollers 396 and 400 are first and second roller drive pulleys 422 and 424, respectively.

An L-shaped idler support bracket 426 having a horizontal leg 428 and a vertical leg 430 is attached to second roller support bracket 380 by one of the allen screws 382. An idler stub shaft 432 is welded to the vertical leg 430 of idler support bracket 426 at weld 434. Rotatably attached to idler stub shaft 432 is an idler pulley 436.

As is best seen in FIG. 8, there is attached to the bottom of table frame 38 an electric drive motor 438. A shaft 440 extends forwardly of motor 438 and has a motor pulley 442 attached thereto.

As best seen in FIGS. 7 and 9, table frame 38 includes an elongated cut out slot 444 through which an upper portion of motor pulley 442 extends. FIG. 9 is a view along line 9—9 of FIG. 8. An endless drive belt, which preferably has a round cross section, is designated by the numeral 446. Drive belt 446 extends under motor pulley 442 then over first drive pulley 422, then under second drive pulley 424, then over idler pulley 436, then back to motor pulley 442.

In this manner, rotation of motor pulley 442 by electric drive motor 438 causes the tapered rollers 396 and 400 to rotate toward each other from above in opposite directions as indicated by arrows 448 and 450, respectively, in FIG. 9.

Manner of Operation of Rollers of FIGS. 7–9

The manner of operation of the roller assembly 34 is as follows.

A plurality of lamps 12 are placed between the rollers 396 and 400 as they are rotating in the manner previously described. These lamps are initially placed between the rollers near the larger ends thereof approximately at the location of the lamp 12 illustrated in phantom lines in FIG. 7 through which the section line 10—10 is drawn.

These lamps 12 are placed onto the roller assembly 34 by conveyor 30. Additionally, lamps 12 may be stored in a tray (not shown) adjacent roller assembly 34 and may be periodically pushed by hand from the tray onto the roller assembly 34. This allows an operator to prevent lamps 12 from bunching up on roller assembly 34 if lamps are being manufactured faster than they are being aged, and also allows the aging conveyor 44 to be utilized if the lamp manufacturing apparatus 24 is shut down.

When the lamps 12 are initially placed on top of the rollers 396 and 400, they need not be oriented in any particular manner. The orientation is accomplished by the rotating rollers regardless of the initial orientation of a lamp 12 when it is dropped on top of the rollers 396 and 400.

As mentioned above, each of the lamps 12 includes the lamp bulb 13 having a lower bulb portion 17 extending from bulb 13 in a direction parallel to the first axis 25 of the bulb 13. The lower bulb portion 17 has a width 18 in a direction parallel to the second body axis 27 of the bulb, and has a thickness 19 less than the width 18 in a direction parallel to a third body axis 29 of the bulb. The first, second and third body axes of the bulb 13 are mutually perpendicular. The first and second lead wires 22 and 23 extend from the lower bulb portion 17 substantially parallel to the first body axis 25 and spaced apart in a direction parallel to the second axis 27.

When such a bulb is placed between the rollers 396 and 400, these rollers orient the bulb so that its first body axis 25 is vertical, with its lead wires 22 and 23 extending downward from the bulb 13, and so that its second body axis 27 is parallel to a predetermined horizontal line 452. It will be understood that once the first and second body axes are oriented, the orientation of the third body axis 29 is necessarily determined thereby. The predetermined horizontal line 452 is parallel to the innermost edges 416 and 418 of rollers 396 and 400 and lies therebetween as projected onto an imaginary horizontal surface.

This orientation is accomplished in the following manner.

When the lamp 12 is initially placed between the rollers 396 and 400, it may be in any orientation. The sliding movement of the rollers 396 and 400 relative to the glass bulb 13 overcomes any static friction between the bulb 13 and the surface of the rollers and causes the bulb 13 to seek to position itself so that it has a minimum gravitational potential energy. In other words, it will fall to the lowest level possible.

The dimensions of the rollers relative to the bulb 13 are such that the rollers contact the outer surface of cylindrical part 14, and since the end of the bulb 13 from which the lead wires 22 and 23 extend is the heaviest, with the center of gravity of the entire lamp 12 being in the area of the junction between cylindrical part 14 and flat bulb portion 17, the lead wires 22 and 23 will swing downward between the rollers 396 and 400 thereby giving the lamp 12 an orientation such that its first body axis 25 is vertically oriented with lead wires extending down from the bulb.

Since the lamp 12 can ride lower between the rollers if it is oriented with its second body axis 27 parallel to predetermined line 452 rather than having its third body axis 29 parallel to said predetermined line, and since the lower corners 454 and 456 of lower bulb part 17 are rounded as seen in FIG. 2, the bulb 12 will orient itself with its second body axis 27 parallel to predetermined line 452.

This entire orientation process takes place very quickly, on the order of one second, once the bulb is dropped between the rotating rollers.

Then the oriented bulb 12 migrates from the position through which section line 10—10 is drawn toward the small ends of the rollers. This is because the elevation at which the bulb 13 of lamp 12 contacts the rollers 396 and 400 drops as the bulb moves to the right as shown in FIG. 7. Again, the continued rotation of the rollers 396 and 400 eliminates static friction between those rollers and the bulb and thus the bulb slowly slides down toward the small end of the tapered rollers.

It is preferable that the surface of the rollers 396 and 400 be finished to at least a No. 8 glossy polish so that the glass bulbs slide freely relative thereto and are not crushed between the rollers. It will be understood that with any particular type of electrical component to be aligned by an apparatus such as that of roller assembly 34, it is necessary that the material against which the rollers are sliding be taken into consideration and that the rollers be so constructed and finished as to provide a sufficiently low co-efficient of friction with the electrical component body to prevent the electrical components from being pulled down between the rollers and crushed.

The sloped line of engagement between the bulbs and the rollers causes the rollers to feed the bulbs to the right, as seen in FIGS. 7 and 8, towards a forwardmost position such as is represented by forwardmost bulb 12A, where the bulb is held between the roller tip inserts such as tip insert 412. Further lateral movement to the right of the forwardmost bulb 12A is prevented by a pair of spring wires 458 and 460, the ends of which engage the forwardmost bulb 12A to resiliently retain the bulb 12A from any further lateral movement to the right. Thus, the bulbs 12 will line up contacting each other, and supported against the forwardmost bulb 12A as shown in FIGS. 7 and 8, and as the forwardmost bulb 12A is removed by the transfer arm 36 the other bulbs are sequentially fed to said predetermined position in space.

The first spring wire 458 is held in a carrier block 462 which is adjustably attached to a vertical leg 464 of an angle shaped bracket 466 by allen screw 468. A horizontal leg 470 of bracket 466 is horizontally adjustably attached to a mounting plate 472 by an alien screw 474. Mounting plate 472 is attached to table frame 38.

A second spring wire holder assembly 476 is similarly constructed and is attached to second spring wire 460.

Thus, the forwardmost lamp 12A is releasably retained at a predetermined position in space, said predetermined position including a predetermined location in space defined between the small ends of rollers 396 and 400 and laterally defined by engagement of forwardmost bulb 12A with spring wires 458 and 460, and including a predetermined orientation about each of three mutually perpendicular spatial axes so that the first body axis of the bulb 12A is oriented vertically with the second body axis of the bulb 12A oriented parallel to predetermined line 452.

Figure 10:
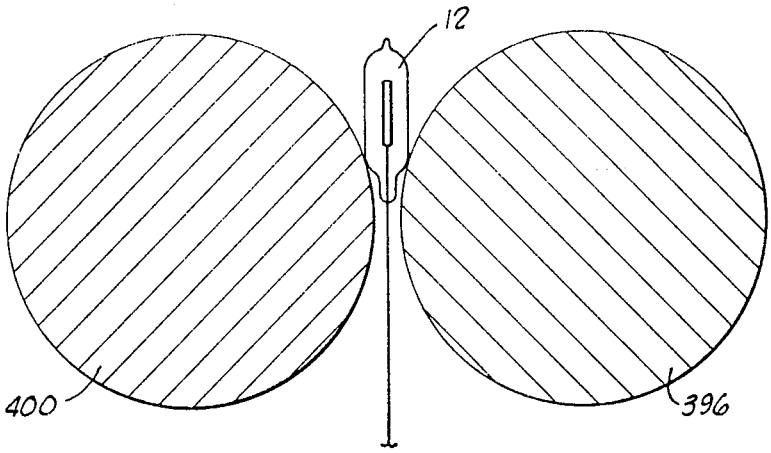
FIGS. 10, 11 and 12 are sectional views taken along lines 10—10, 11—11, and 12—12, respectively, of FIG. 7, illustrating the manner in which a negative glow lamp engages the tapered rollers at each of those locations.
Figure 11:
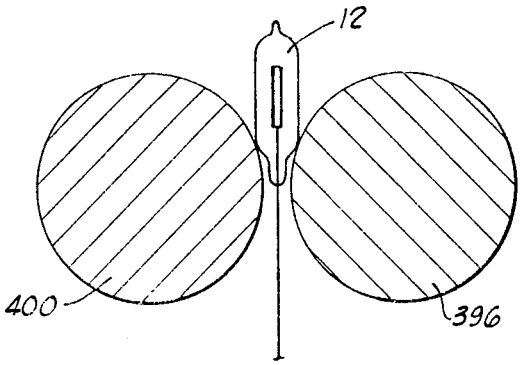
Figure 12:
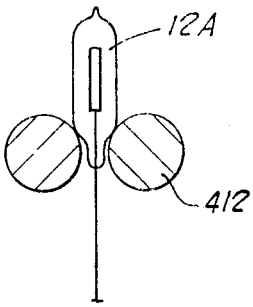

The manner in which the line of contact, between the bulbs 13 and the rollers 396 and 400, slopes downard to the right as the bulbs travel to the right, can best be understood by viewing FIGS. 7, 10, 11 and 12. FIGS. 10, 11 and 12 are section views taken along the sections indicated at FIG. 7.

As best can be seen in FIG. 8, an axis of rotation 478 of first roller 396, which in elevation is parallel to the axis of rotation of roller 400, but which in plan is not as can be seen in FIG. 7, is not horizontally oriented, but rather is tilted downward to the right as a slight angle 480 from the horizontal.

Even if the rollers 396 and 400 were cylindrical rollers, it will be appreciated that if the axis of rotation of those rollers were tilted from the horizontal, then the line of contact of the bulbs with the rollers, which line of contact would be parallel to the axis of rotation, would also be sloped and thus the bulbs could slide down the sloped roller assembly.

With the tapered rollers 396 and 400 of the present invention, another factor is introduced in that, even if the rotational axis such as axis 478 were horizontal, the line of contact between the bulbs 13 and the rollers would still be sloped "downward" toward the small end of the rollers because the bulbs are held at a higher elevation when they are near the large end of the rollers than they are when they are near the small end of the rollers. This can best be appreciated by viewing FIGS. 10, 11 and 12 which illustrate the relative position of bulb 13 as it moves to the right between the rollers 396 and 400.

The line of contact between the bulbs 13 and the roller 396 is designated as 482 in FIG. 8, and it can be seen that the line 482 is not parallel to the axis of rotation 478, but rather the axis 478 and the line 482 converge to the right.

For a given type of electrical component and a given coefficient of friction between that component and the rollers, the line of contact 482 must be sloped sufficiently so that the gravitational force acting upon the electrical components is sufficient to overcome sliding frictional resistance and then the lamps will slide down the rollers. Thus, when rollers 396 and 400 are described as "substantially horizontally extending" it will be understood that their axes of rotation need not be exactly horizointal.

For the glass bulb 13 of lamps 12 having the dimensions previously described, and for the rollers 396 and 400 having the dimensions previously described and having a No. 8 glossy polish, it is desirable that the axis of rotation 478 be sloped approximately 7°, i.e., the angle 480 should be approximately 7°.

Adjustment bolt 372 provides a means for adjusting the degree of slope of the line of contact 482.

Another important feature provided by the conical taper of rollers 396 and 400 is that the final position of each lamp 12 is between the small ends of the rollers. This makes it much easier to then engage the lamps with the lamp holder of transfer arm 36 than it would be if the rollers were not tapered and were instead cylindrical with a diameter equal to that of large end 408. If the rollers were cylindrical with a constant diameter like small end 410, on the other hand, they would be much less effective for initially orienting the lamps. Thus, tapered rollers are far superior to cylindrical rollers.

Figure 13:
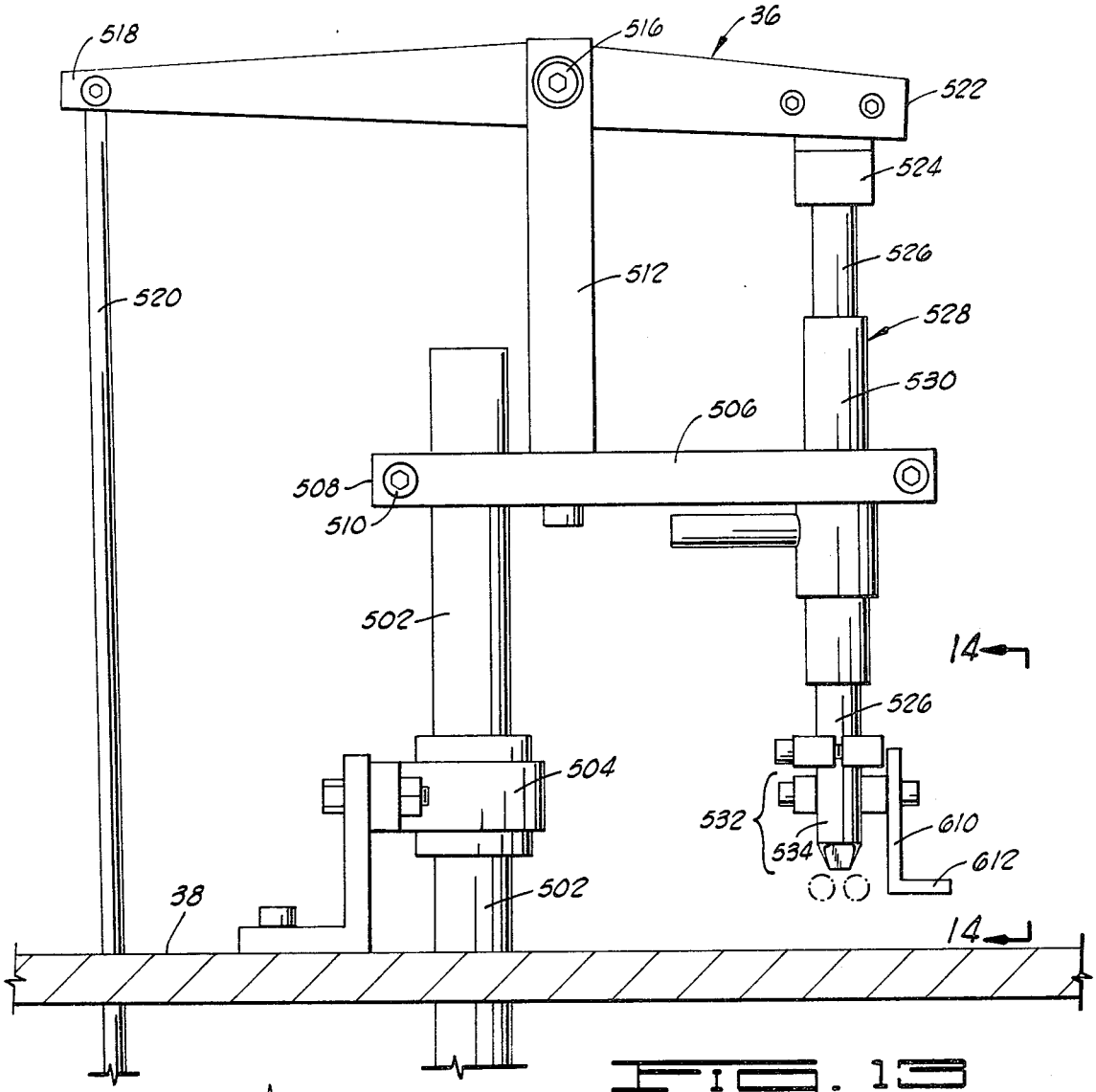
FIG. 13 is a side elevation view of a transfer rod and a lamp holder.

Transfer Arm of FIG. 13

Referring now to FIG. 13, a side elevation view is thereshown of first transfer arm 36.

A vertical support shaft 502 extends upward through table frame 38. The shaft 502 extends through a bearing block 504 which is attached to table frame 38. Extending horizontally from an upper part of shaft 502 is a horizontal bar 506 which has a split end 508 which is held about shaft 502 by a clamping screw 510.

Extending upward from horizontal bar 506 is a vertical fulcrum support 512 to which transfer arm 36 is pivotally attached at a pivot pin 516.

A rear end 518 of transfer arm 36 is attached to a vertical linkage 520 which extends downward through table frame 38 to a cam operated drive mechanism (not shown). A forward end 522 of transfer arm 36 is pivotally attached to a bracket 524 attached to a center rod 526 of a lamp holder generally designated by the numeral 528. The lamp holder 528 includes a friction tube 530 which is rigidly attached to horizontal arm 506.

Figure 14:
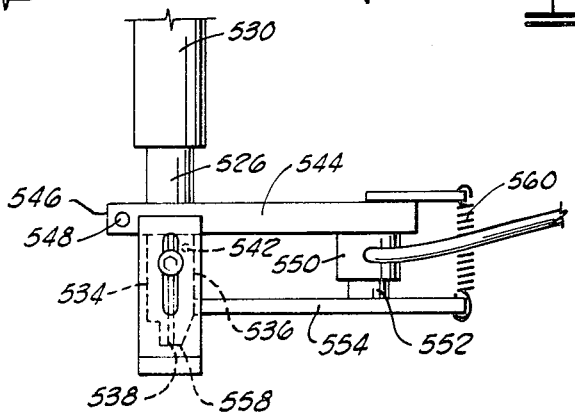
FIG. 14 is an elevation view along line 14—14 of FIG. 13 showing the actuating means for the lamp holder.

Center rod 526 extends through friction tube 530 and has a lower portion 532 which is split into two semicylindrical downward extending fingers 534 and 536 by a vertically extending cut 538 (see FIG. 14). The finger 534 has a notch 540 therein to prevent the second forwardmost lamp 12 from being crushed when the forwardmost lamp 12A is picked from between the rollers of lamp alignment roller assembly 34.

Central rod 526 has a central bore (not shown) in the lower end thereof for the length of lower part 532. Finger 536 is preferably attached to the remainder of center rod 526 by a pivot pin 542, rather than being cantilevered. This is because of the high bending stresses encountered when using a fluid power cylinder to flex the finger 536.

Extending horizontally from center rod 526 is an air cylinder support bar 544, a split end 546 of which is clamped about center rod 526 by clamping screw 548.

Attached to a lower side of support bar 544 is an air cylinder 550 which has a piston 552 extending downwardly therefrom which is attached to a cantilever bar 554 which extends horizontally outward from finger 536 of center rod 526 and which is welded to finger 536.

As mentioned, center rod 526 has a center bore extending upward from a lower end 558 thereof for the length of the lower portion 532 of center rod 526. That center bore is dimensioned so that when piston 552 is extended a lamp 12 may be tightly held between fingers 534 and 536, and when air pressure to cylinder 550 is released a return spring 560 pulls finger 536 away from finger 534 to release the lamp 12.

Horizontal movement of a lamp 12 away from rollers 396 and 400 is achieved by rotation of shaft 502 counterclockwise as seen in FIG. 1, to the position shown in phantom lines in FIG. 1, where the lamp 12 is held above aging conveyor 44.

Then the separator and alignment apparatus 48, shown schematically in FIG. 1, aligns the lead wires 22 and 23 of each lamp 12 with lead wire receptacles of one of the carrier blocks 50 of conveyor 44, and the lead wires are inserted in the receptacles. This is accomplished as follows.

Figures 15, 16, 17:
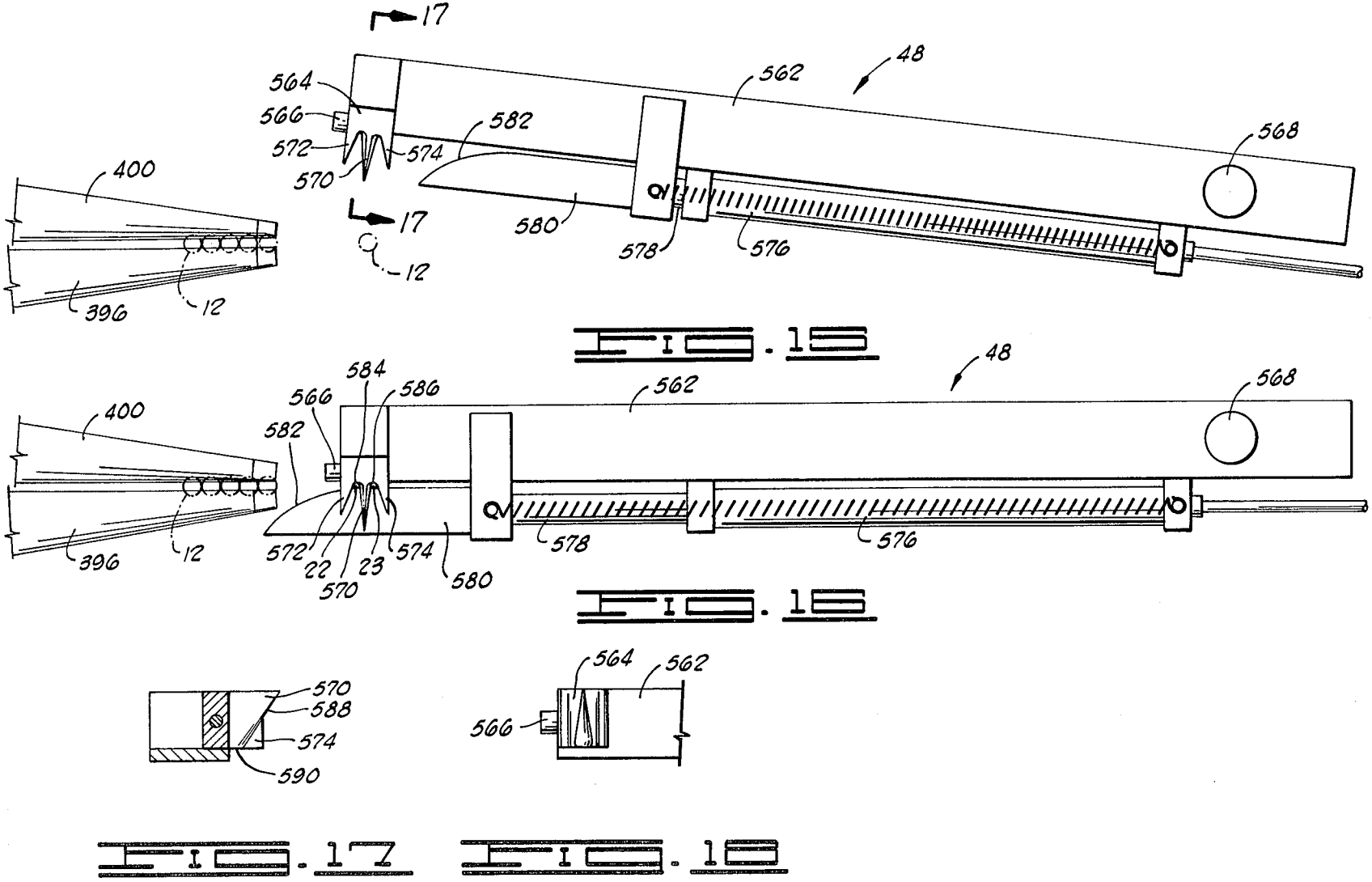
FIGS. 15 and 16 are plan view of a lead wire separator and alignment apparatus.
FIG. 17 is a section elevation view along line 17—17 of FIG. 15, showing the separator insert.

The seperator and alignment apparatus 48 is shown in FIG. 15 in position relative to a lamp 12 illustrated in phantom lines, in the position in which it would be held by lamp holder 528 above conveyor 44.

The separator and alignment apparatus 48 includes a horizontal arm 562 which has a separator insert 564 attached to the left end thereof by attachment screw 566. Arm 562 is attached to a pivotable vertical support rod 568.

Separator insert 564 includes a longer middle separator blade 570 which is inserted between the lead wires 22 and 23 of the lamp 12.

Separator insert 564 also includes two shorter outer blades 572 and 574. When the separator and alignment apparatus 48 moves forward from the position shown in FIG. 15 to the position shown in FIG. 16 relative to the lamp 12, by counterclockwise rotation of support rod 568, the middle separator blade 570 is inserted between the lamp lead wires which are disposed respectively between the two shorter blades 572 and 574 and the middle blade 570.

The separator and alignment apparatus 48 also includes an air cylinder 576 which is attached to a side thereof. A piston 578 extends from air cylinder 576 and has a cam blade 580 attached thereto. Cam blade 580 is shaped in profile much like a conventional knife blade as seen in FIGS. 15 and 16, but it will be understood as further described below that a curved portion 582 of cam blade 580 is not sharp, but rather functions as a cam to align the lead wires 22 and 23 of the lamp 12 at roots 584 and 586 of separator insert 564. Roots 584 and 586 may be described as two predetermined locations on opposite sides of separator blade 570.

After the horizontal arm 562 has pivoted forward from the position shown in FIG. 15 to the position shown in FIG. 16, the lamp lead wires are disposed on opposite sides of separator blade 570. Then cam blade 580 is moved to the left relative to horizontal arm 562 by extension of piston 578 thereby causing the lamp lead wires to be moved into the roots 584 and 586 of separator insert 564 as may be seen in FIG. 16.

The separator and alignment apparatus 48 may then be moved downward relative to the lamp holder 528, by vertical downward movement of support rod 568, so as to comb the length of lead wires 22 and 23 of lamp 12, thereby straightening them and aligning the lead wires with the receptacles of one of the carrier blocks 50.

Then the front end 522 of transfer arm 36 tips downward to insert the lamp 12 in the aging conveyor 44. When lamp 12 first inserted in aging conveyor 44, it may be said to have been transferred by transfer arm 36 from a first predetermined position on roller assembly 34, to a second predetermined position on aging conveyor 44.

Next, cam blade 580 retracts and arm 562 pivots back to the original position of FIG. 15, moving out of engagement with the lamp 12.

FIG. 17 shows a view along line 17—17 of FIG. 15 which shows the side elevation profile of separator blade 570. FIG. 18 shows a front elevation view of separator insert 564.

As can be seen in FIGS. 17 and 18, the middle blade 570 has a sloped lower surface 588 which thickens toward the bottom 590 of insert 564.

The Aging Conveyor

Figure 19:
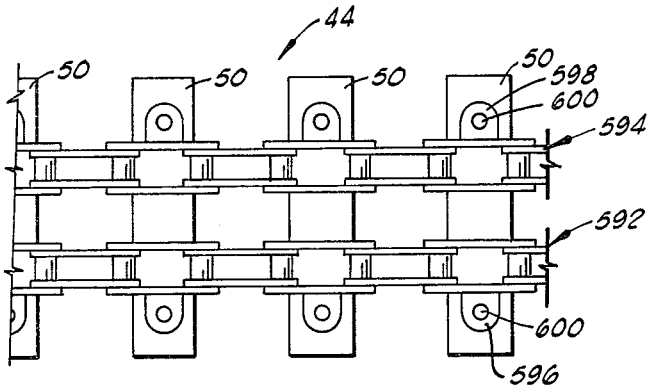
FIG. 19 is a bottom view of a portion of the lamp aging conveyor.
Figure 21:
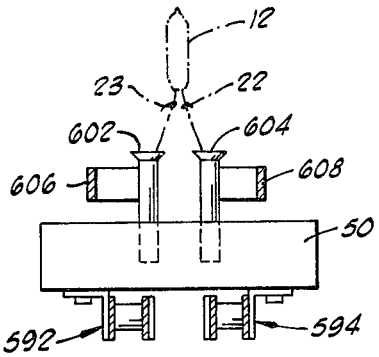
FIG. 21 is an elevation view aong line 21—21 of FIG. 20 showing one of the carrier blocks of the lamp aging conveyor.
Figure 20:
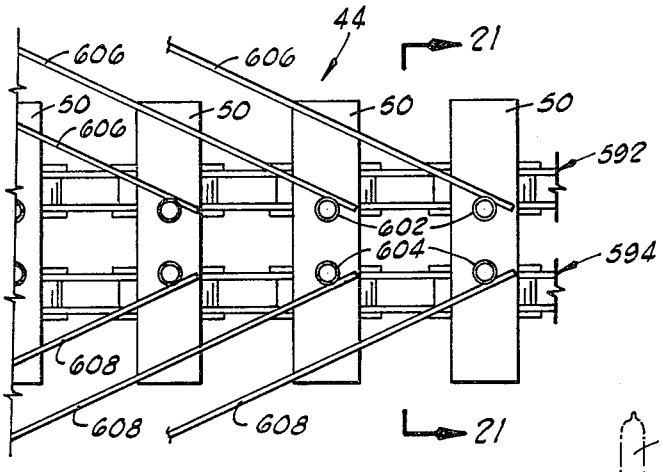
FIG. 20 is a top plan view of a portion of the lamp aging conveyor.

Details of construction of the aging conveyor 44 are shown in FIGS. 19-21. FIG. 19 is a bottom view of a section of the conveyor 44. FIG. 20 is a top plan view of the conveyor 44. FIG. 21 is a section elevation view along line 21—21 of FIG. 20, showing one of the carrier blocks 50.

The conveyor 44 includes first and second parallel endless roller chains 592 and 594. Alternating links of the chains include tabs 596 and 598 which are attached to the bottom of one of the carrier blocks 50 by screws 600.

Extending upward from each of the carrier blocks 50, which are insulated carrier blocks, are a pair of electrically conductive lead wire receptacles 602 and 604.

When the lead wires 22 and 23 of each lamp 12 are aligned by apparatus 48 and inserted into aging conveyor 44, they are received substantially as shown in FIG. 21.

Arranged parallel to and on opposite sides of conveyor 44 are a row of first electrical contacts 606 and a row of second electrical contacts 608. Contacts 606 and 608 are electrically connected to first and second current conductors (not shown) and have free ends which brush against the lead wire receptacles 602 and 604 as the conveyor 44 moves to the right relative to contacts 606 and 608.

When a carrier block 50 is in a position as shown in FIG. 21 in contact with contacts 602 and 604, a current is passed through the lamp 12 carried by carrier block 50. Thus, as a given lamp 12 is carried down conveyor 44 an electric current is repeatedly directed thereto by brush contacts 606 and 608.

Figure 22:
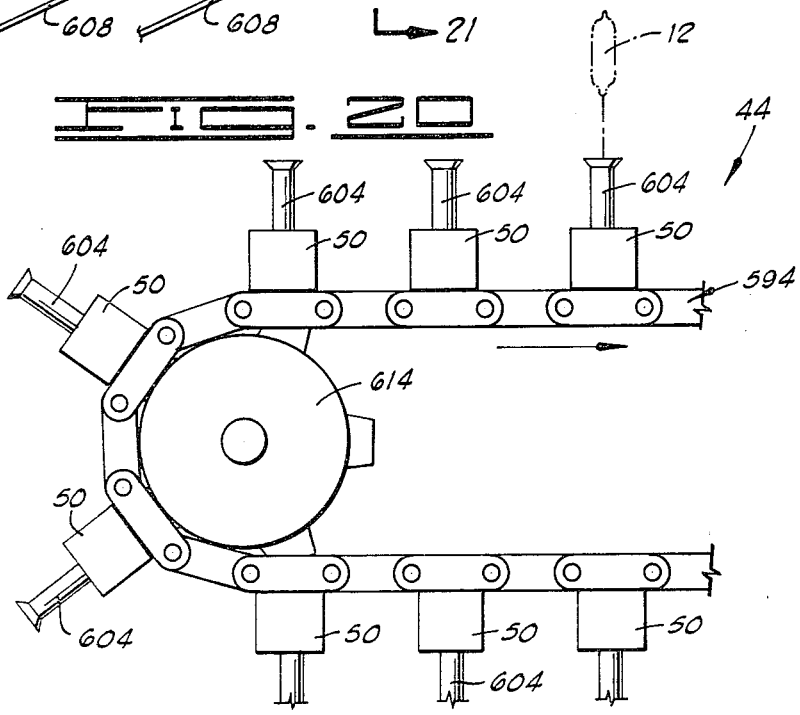
FIG. 22 is a side elevation view of the lamp aging conveyor.

FIG. 22 shows a side elevation view of aging conveyor 44, and illustrates a drive sprocket 614 for driving conveyor 44.

Referring again to FIG. 13, an L-shaped bracket 610 is attached to center rod 526. A lower leg 612 of bracket 610 aids in the insertion of lead wires 22 and 23 of lamps 12 into receptacles 602 and 604. When center rod 526 moves downward it inserts the lead wires to a certain extent and then releases the lamp 12. On the next cycle of the system, the lamp 12 just inserted has moved to the right in FIG. 13 to a position just below leg 612. Then on the next downward movement of center rod 526, leg 612 pushes down on the lamp 12 below it to further insert that lamp 12 into the receptacles of its conveyor block 50.

Drive Mechanism

Located below table frame 38 is a drive system (not shown) including a camshaft driven by an electric motor.

The aging conveyor 44 is driven by a cog type gear from a first cam of the camshaft, so that conveyor 44 advances stepwise the distance between adjacent carrier blocks 50 with each revolution of the camshaft. This cog gear is connected to a conventional sprocket type drive represented schematically by sprocket 614 shown in FIG. 22.

A second cam and suitable connecting linkage imparts rotational motion to rod 568 of FIGS. 15 and 16.

A third cam and suitable connecting linkage imparts reciprocating motion to rod 568.

A fourth cam reciprocates linkage 520 of FIG. 13.

A fifth cam and suitable connecting linkage imparts rotational motion to shaft 502 of FIG. 13.

Thus, it is seen that the methods and apparatus of the present invention readily achieve the ends and advantages mentioned as well as those inherent therein. While certain preferred embodiments have been illustrated for the purpose of this disclosure, numerous changes in the arrangement and construction of parts may be made by those skilled in the art, which changes are encompassed within the scope and spirit of this invention as defined by the appended claims.

What is claimed is:

1. An automated method of aging negative glow lamps, comprising:

(a) mechanically orienting a plurality of lamps with a lamp orienting means, each of said lamps including a bulb with first and second lamp lead wires extending therefrom, so that said lamps may be received by a lamp holder;

(b) feeding said oriented lamps to a first predetermined position;

(c) receiving each of said lamps one at a time in said lamp holder when said lamps are in said first predetermined position;

(d) transferring, by movement of said lamp holder, each of said lamps from said first predetermined position to a second predetermined position where said first and second lead wires of each lamp are received in a pair of lead wire receptacles of a lamp aging conveyor, said conveyor including a plurality of pairs of lead wire receptacles so that a plurality of lamps may be conveyed simultaneously;

(e) driving said lamp aging conveyor, thus conveying each of said lamps away from said second predetermined position; and (f) while each of said lamps is on said lamp aging conveyor, directing an electric current to said pair of lead wire receptacles and thus to said first and second lead wires to age said lamps on said lamp aging conveyor.

2. The method of claim 1, wherein said transferring step comprises:

moving said lamp holder and each of said lamps laterally away from said first predetermined position to a position above said lamp aging conveyor;

aligning said first and second lead wires of each of said lamps with first and second receptacles of one of said pairs of lead wire receptacles of said lamp aging conveyor; and moving said lamp holder and each of said lamps downward; thereby inserting said lead wires of each of said lamps into one of said pairs of lead wire receptacles of said lamp aging conveyor.

3. The method of claim 2, wherein said aligning step comprises:

moving a separator blade between said first and second lead wires of each of said lamps when each of said lamps is in said position above said lamp aging conveyor;

thereby separating said first and second lead wires;

engaging said lead wires with a cam blade and thereby locating said lead wires at two predetermined locations on opposite sides of said separator blade; and moving said separator blade and cam blade downward relative to said lamp;

thereby combing said first and second lead wires into alignment with said one of said pairs of receptacles of said lamp aging conveyor.

4. The method of claim 1, wherein:

said step (f) is further characterized in that electric current is repeatedly directed to and disconnected from each of said pairs of lead wire receptacles and thus to and from each of said lamps while said lamps are on said lamp aging conveyor.

5. The method of claim 1, further comprising, prior to step (a):

periodically receiving batches of lamps, from a lamp manufacturing apparatus, in a lamp feeder apparatus;

releasing said lamps of each batch one lamp at a time onto a lamp feeding conveyor; and conveying said lamps in a single line on said lamp feeding conveyor to said lamp orienting means.

6. The method of claim 5, wherein:

said step of periodically receiving batches of lamps is further characterized as periodically dropping batches of lamps into a plurality of parallel inclined chutes of said lamp feeder apparatus, each of said batches including a plurality of lamps which are dropped simultaneously one into each of said chutes; and said step of releasing said lamps of each batch is further characterized as opening said chutes one at a time thereby allowing said lamps one at a time to slide out of their respective chutes.

7. The method of claim 6, wherein:

said step of opening said chutes is further characterized as rotating a camshaft having a plurality of eccentric cams thereon engaged with a plurality of spring strips one of which extends into each of said chutes, so that said spring strips one at a time raise up above a bottom surface of said chutes to allow a lamp to slide down said chute below said raised strip.

8. The method of claim 1, further comprising:

receiving each of said lamps in a second lamp holder at an end of said lamp aging conveyor; and transferring, by movement of said second lamp holder, each of said lamps from said lamp aging conveyor.

9. The method of claim 1, wherein:

said orienting step is further characterized as placing each of said lamps between a pair of rotating rollers of said lamp orienting means so that said bulb of each of said lamps is engaged by both of said rollers.

10. The method of claim 9, wherein:

said feeding step is further characterized as gravity feeding said oriented lamps sequentially along a predetermined path between said rotating rollers.

11. The method of claim 10, further comprising:

releasably retaining each of said lamps at said first predetermined position.

12. The method of claim 10, wherein:

said gravity feeding step is further characterized as feeding said oriented lamps sequentially toward small ends of said rotating rollers, said rotating rollers being continuously conically tapered between a location thereon where said lamps are initially placed and said small ends.

13. An automated method of handling electrical components, comprising:

(a) mechanically positioning, with a component positioning means, in sequence at a first predetermined position a plurality of electrical components of the type including:

a body;

a lower body portion extending from said body in a direction parallel to a first axis of said body, said lower body portion having a width in a direction parallel to a second axis of said body, and a thickness less than said width in a direction parallel to a third axis of said body, said first, second and third body axes being mutually perpendicular; and first and second lead wires extending from said lower body portion substantially parallel to said first body axis and spaced apart in a direction parallel to said second axis;

said positioning step including the steps of:

orienting each of said electrical components so that said first body axis thereof is vertical, with said lead wires extending downward from said body, and so that said second body axis is parallel to a predetermined horizontal line; and feeding said oriented electrical components to a predetermined location in space;

said first predetermined position of said electrical components being defined by said predetermined location in space, said vertical orientation of said first body axes, and said orientation of said second body axes parallel to said predetermined horizontal line;

(b) receiving each of said electrical components one at a time in a component holder when said components are in said first predetermined position;

(c) transferring, by movement of said component holder, each of said components from said first predetermined position to a second predetermined position where said first and second lead wires of each electrical component are received in a pair of lead wire receptacles of a first component conveyor, said conveyor including a plurality of pairs of lead wire receptacles so that a plurality of electrical components may be conveyed simultaneously; and (d) driving said component conveyor thus conveying each of said electrical components away from said second predetermined position.

14. The method of claim 13, wherein said transferring step comprises:

moving said component holder and each of said electrical components laterally away from said first predetermined position to a position above said component conveyor;

aligning said first and second lead wires of each of said electrical components with first and second receptacles of one of said pairs of lead wire receptacles of said component conveyor; and moving said component holder and each of said electrical components downward; thereby inserting said lead wires of each of said electrical components into one of said pairs of lead wire receptacles of said component conveyor.

15. The method of claim 14, wherein said aligning step comprises:

moving a separator blade between said first and second lead wires of each of said electrical components when each of said electrical components is in said position above said component conveyor;

thereby separating said first and second lead wires;

engaging said lead wires with a cam blade and thereby locating said lead wires at two predetermined locations on opposite sides of said separator blade; and moving said separator blade and cam blade downward relative to said electrical component;

thereby combing said first and second lead wires into alignment with said one of said pairs of receptacles of said component conveyor.

16. The method of claim 13, further comprising:

while each of said electrical components is on said component conveyor, directing an electric current to said pair of lead wire receptacles and thus to said first and second lead wires of each of said electrical components.

17. The method of claim 16, wherein:

said step of directing electric current is further characterized in that electric current is repeatedly directed to and disconnected from each of said pairs of lead wire receptacles and thus to and from each of said electrical components while said electrical components are on said component conveyor.

18. The method of claim 13, further comprising, prior to step (a):

periodically receiving batches of electrical components, from a component manufacturing apparatus, in a component feeder apparatus;

releasing said electrical components of each batch one component at a time onto a component feeding conveyor; and conveying said electrical components in a single line on said component feeding conveyor to said component positioning means.

19. The method of claim 18, wherein:

said step of periodically receiving batches of lamps is further characterized as periodically dropping batches of electrical components into a plurality of parallel inclined chutes of said component feeder apparatus, each of said batches including a plurality of electrical components which are dropped simultaneously one into each of said chutes; and said step of releasing said electrical components of each batch is further characterized as opening said chutes one at a time thereby allowing said electrical components one at a time to slide out of their respective chutes.

20. The method of claim 19, wherein:

said step of opening said chutes is further characterized as rotating a camshaft having a plurality of eccentric cams thereon engaged with a plurality of spring strips one of which extends into each of said chutes, so that said spring strips one at a time raise up above a bottom surface of said chutes to allow an electrical component to slide down said chute below said raised strip.

21. The method of claim 13, further comprising:

receiving each of said electrical components in a second component holder at an end of said first component conveyor; and transferring, by movement of said second component holder, each of said electrical components from said first component conveyor.

22. The method of claim 13, wherein:

said orienting step is further characterized as placing each of said electrical components between a pair of rotating rollers of said component positioning means so that said body of each of said electrical components is engaged by both of said rollers.

23. The method of claim 22, wherein:

said feeding step is further characterized as gravity feeding said oriented electrical components sequentially along a predetermined path between said rotating rollers.

24. The method of claim 23, further comprising:

releasably retaining each of said electrical components at said first predetermined position.

25. The method of claim 23, wherein:

said gravity feeding step is further characterized as feeding said oriented electrical components sequentially toward small ends of said rotating rollers, said rotating rollers being continuously conically tapered between a location thereon where said electrical components are initially placed and said small ends.

26. An automated system for aging negative glow lamps, comprising:

positioning means for orienting a plurality of lamps, each of said lamps including a bulb with first and second lamp lead wires extending from one end thereof, and for feeding said oriented lamps to a first predetermined position;

a lamp holder;

actuating means for actuating said lamp holder so that each of said lamps is received one at a time in said lamp holder when said lamps are in said first predetermined position;

a lamp aging conveyor including a plurality of pairs of lead wire receptacles;

transfer means for moving said lamp holder and each of said lamps from said first predetermined position to a second predetermined position where said first and second lead wires of each lamp are received in one of said pairs of lead wire receptacles of said lamp aging conveyor;

drive means for driving said lamp aging conveyor and for conveying each of said lamps away from said second predetermined position; and electrical contact means for directing an electric current to each of said pairs of lead wire receptacles and thus to said lead wires of each of said lamps while each of said lamps is on said lamp aging conveyor.

27. The system of claim 26, wherein:

said positioning means includes a pair of rotating rollers arranged and constructed so that said bulb of each of said lamps is engaged by both of said rollers.

28. The system of claim 27, wherein:

said positioning means is further characterized in that said pair of rotating rollers rotate in opposite directions and inwardly from above toward each other.

29. The system of claim 27, wherein:

said rollers have a polished surface for slidingly engaging said bulbs of said lamps.

30. The system of claim 27, wherein:

innermost edges of said rollers are oriented parallel to each other and are separated by a distance less than a greatest minimum cross-sectional dimension of said bulbs of said lamps so that said bulbs rest on top of said rollers with said lead wires extending downward between said rollers.

31. The system of claim 27, wherein:

said feeding function of said positioning means is provided by an orientation of said rotating rollers such that a line of contact between the bulb of one of said lamps and one of said rotating rollers slopes downward from a part of said rollers where said bulb of said lamp initially contacts said rollers toward said first predetermined position.

32. The system of claim 31, wherein:

said rollers are tapered rollers, each of said rollers tapering from a large end to a small end, said first predetermined position below adjacent and between said small ends of said rollers.

33. The system of claim 32, further comprising:

releasable retaining means for releasably retaining each of said lamps at said first predetermined position.

34. The system of claim 26, further comprising:

a lamp feeder means for periodically receiving batches of said lamps from a lamp manufacturing apparatus and for releasing said lamps of each batch one lamp at a time; and a lamp feeding conveyor, operably associated with said lamp feeder means, for receiving said lamps released from said lamp feeder means and for conveying said lamps in a single line to said positioning means.

35. The system of claim 34, wherein said lamp feeder means comprises:

an inclined surface divided by side walls into a plurality of parallel chutes, said surface being sufficiently inclined so that lamps placed in said chutes at upper ends thereof will slide down said chutes due to gravity; and sequencing means, operably associated with said plurality of chutes, for causing said chutes to be opened one at a time.

36. The system of claim 35, wherein said lamp feeder means further comprises:

converging side wall means attached to a lower portion of said inclined surface below said chutes, for directing lamps from each of said chutes to a single lamp feeder outlet.

37. The system of claim 35, wherein:

said sequencing means includes a rotatable camshaft including a plurality of cams, one of said cams controlling movement of lamps down each of said chutes.

38. The system of claim 37, wherein:

said camshaft is located above said chutes with one of said cams extending toward each of said chutes.

39. The system of claim 38, wherein said lamp feeder means further comprises:

a plurality of spring strips extending into each of said chutes between said cams and said inclined surface so that engagement of said cams with said strips causes each of said strips to cyclically move between a down position blocking movement of a lamp down its respective chute and an up position allowing said lamp to slide down its respective chute between said strip and said inclined surface.

40. An automated system for handling electrical components, comprising:

(a) positioning means for mechanically positioning in sequence at a first predetermined position a plurality of electrical components of the type including:

a body;

a lower body portion extending from said body in a direction parallel to a first axis of said body, said lower body portion having a width in a direction parallel to a second axis of said body, and a thickness less than said width in a direction parallel to a third axis of said body, said first, second and third body axes being mutually perpendicular; and first and second lead wires extending from said lower body portion substantially parallel to said first body axis and spaced apart in a direction parallel to said second axis;

said positioning means including:

orientation means for orienting each of said electrical components so that said first body axis thereof is vertical, with said lead wires extending downward from said body, and so that said second body axis is parallel to a predetermined horizontal line; and feeder means for feeding said oriented electrical components to a predetermined location in space;

said first predetermined position of said electrical components being defined by said predetermined location in space, said vertical orientation of said first body axes, and said orientation of said second body axes parallel to said predetermined horizontal line;

(b) a component holder;

(c) actuating means for actuating said component holder so that each of said components is received one at a time in said component holder when said components are in said first predetermined position;

(d) a first component conveyor including a plurality of pairs of lead wire receptacles;

(e) transfer means for moving said component holder and each of said components from said first predetermined position to a second predetermined position where said first and second lead wires of each component are received in one of said pairs of lead wire receptacles of said first component conveyor; and (f) drive means for driving said first component conveyor and for conveying each of said components away from said second predetermined position.

41. The system of claim 40, further comprising:

electrical contact means for directing an electric current to each of said pairs of lead wire receptacles and thus to said lead wires of each of said components while each of said components is on said first component conveyor.

42. The system of claim 40, wherein:

said positioning means includes a pair of rotating rollers arranged and constructed so that said body of each of said electrical components is engaged by both of said rollers.

43. The system of claim 42, wherein:

said positioning means is further characterized in that said pair of rotating rollers rotate in opposite directions and inwardly from above toward each other.

44. The system of claim 42, wherein:

said rollers have a polished surface for slidingly engaging said bodies of said electrical components.

45. The system of claim 42, wherein:

innermost edges of said rollers are oriented parallel to each other and are separated by a distance less than a greatest minimum cross-sectional dimension of said bodies of said electrical components so that said bodies rest on top of said rollers with said lead wires extending downward between said rollers.

46. The system of claim 42, wherein:

said feeder means is provided by an orientation of said rotating rollers such that a line of contact between the body of one of said electrical components and one of said rotating rollers slopes downward from a part of said rollers where said body of said electrical component initially contacts said rollers toward said predetermined location in space.

47. The system of claim 46, wherein:

said rollers are tapered rollers, each of said rollers tapering from a large end to a small end, said predetermined location in space being adjacent and between said small ends of said rollers.

48. The system of claim 47, further comprising:

releasable retaining means for releasably retaining each of said electrical components at said predetermined location in space.

49. The system of claim 40, further comprising:

a component feeder means for periodically receiving batches of said electrical components from a component manufacturing apparatus and for releasing said components of each batch one component at a time; and a component feeding conveyor, operably associated with said component feeder means, for receiving said components released from said component feeder means and for conveying said components in a single line to said positioning means.

50. The system of claim 49, wherein said component feeder means comprises:

a support frame;

an inclined surface attached to said support frame;

a plurality of walls extending upward from an upper portion of said inclined surface and dividing said upper portion of said inclined surface into a plurality of chutes, there being at least one chute for each electrical component of said batch of electrical components; and a camshaft, rotatingly mounted upon said frame, and including a plurality of eccentric cams one of which is operably associated with each of said chutes for periodically blocking and periodically opening each of said chutes, said cams being arranged so that said plurality of chutes are opened one at a time thereby permitting said batch of electrical components to pass one at a time through said component feeder means.

51. The system of claim 50, wherein:

said camshaft is located above said inclined surface and said eccentric cams extend downward toward said chutes.

52. The system of claim 51, wherein said component feeder means further comprises:

a plurality of spring strips extending into each of said chutes between said eccentric cams and said inclined surface so that engagement of said eccentric cams with said strips causes each of said strips to cyclically move between a down position blocking movement of an electrical component down its respective chute and an up position allowing an electrical component to slide down its respective chute between said strip and said inclined surface.

* * * * *